US008750731B2

(12) United States Patent
Inoue

(10) Patent No.: US 8,750,731 B2
(45) Date of Patent: Jun. 10, 2014

(54) IMAGE FORMATION APPARATUS

(75) Inventor: Hiroyuki Inoue, Tokyo (JP)

(73) Assignee: Oki Data Corporation, Tokyo (JP)

( * ) Notice: Subject to any disclaimer, the term of this patent is extended or adjusted under 35 U.S.C. 154(b) by 140 days.

(21) Appl. No.: 13/354,865

(22) Filed: Jan. 20, 2012

(65) Prior Publication Data

US 2012/0195607 A1 Aug. 2, 2012

(30) Foreign Application Priority Data

Jan. 28, 2011 (JP) ..... 2011-016101

(51) Int. Cl.
*G03G 15/00* (2006.01)

(52) U.S. Cl.
USPC ..... 399/38; 399/66

(58) Field of Classification Search
USPC ..... 399/38
See application file for complete search history.

(56) References Cited

U.S. PATENT DOCUMENTS 6,691,399 B1 * 2/2004 Hayashi et al. ..... 29/605

FOREIGN PATENT DOCUMENTS

| | | | |
|---|---|---|---|
| JP | H04-050961 | A | 2/1992 |
| JP | H05-019583 | A | 1/1993 |
| JP | 2002-240983 | A | 8/2002 |
| JP | 2006-124058 | A | 5/2006 |

* cited by examiner

*Primary Examiner* — Clayton E Laballe
*Assistant Examiner* — Jas Sanghera
(74) *Attorney, Agent, or Firm* — Marvin A. Motsenbocker; MOTS LAW, PLLC

(57) ABSTRACT

An image formation apparatus includes an image carrier on which a developer image is to be formed, an image transfer device configured to transfer the developer image formed on the image carrier to a medium at an image transfer position, a controller configured to control drive of the image carrier and the image transfer device, a first medium feeder configured to feed the medium to the image transfer position along a medium conveyance path extending from the first medium feeder to the image transfer position, and a medium detector provided between the first medium feeder and the image transfer position in the medium conveyance path. The controller is configured to control the drive of the image carrier on the basis of a medium-detection result by the medium detector.

45 Claims, 14 Drawing Sheets

CONFIGURATION OF IMAGE FORMATION APPARATUS IN FIRST EMBODIMENT

CONFIGURATION OF IMAGE FORMATION UNIT OF IMAGE FORMATION APPARATUS SHOWN IN FIG. 1

CIRCUIT CONFIGURATION OF MAIN BODY OF IMAGE FORMATION APPARATUS SHOWN IN FIG. 1

CIRCUIT CONFIGURATION OF OPTIONAL TRAY OF IMAGE FORMATION APPARATUS SHOWN IN FIG. 1

FIG. 5 FLOWCHART OF IMAGE FORMATION APPARATUS IN FIRST EMBODIMENT

TIME CHART OF IMAGE FORMATION APPARATUS IN FIRST EMBODIMENT

RELATIONSHIP BETWEEN SURFACE POTENTIAL OF PHOTOSENSITIVE DRUM SHOWN IN FIG. 2 AND ELAPSED TIME

FIG. 8 FLOWCHART (PART 1) OF IMAGE FORMATION APPARATUS IN SECOND EMBODIMENT

TIME CHART OF IMAGE FORMATION APPARATUS IN SECOND EMBODIMENT

FIG. 11 FLOWCHART OF IMAGE FORMATION APPARATUS IN THIRD EMBODIMENT

TIME CHART OF IMAGE FORMATION APPARATUS IN THIRD EMBODIMENT

FLOWCHART OF IMAGE FORMATION APPARATUS IN FOURTH EMBODIMENT

TIME CHART OF IMAGE FORMATION APPARATUS IN FOURTH EMBODIMENT

IMAGE FORMATION APPARATUS

CROSS REFERENCE TO RELATED APPLICATIONS

This application claims priority based on 35 USC 119 from prior Japanese Patent Application No. 2011-016101 filed on Jan. 28, 2011, entitled "IMAGE FORMATION APPARATUS", the entire contents of which are incorporated herein by reference.

BACKGROUND OF THE INVENTION

1. Field of the Invention

The present disclosure relates to an image formation apparatus of electrophotography or the like.

2. Description of Related Art

A conventional image formation apparatus transfers a toner image as a developer image to a sheet as a medium by means of a photosensitive drum as an image carrier and an image transfer roller as an image transfer device as disclosed, for example, in Japanese Patent Application Laid-open No. 2006-124058.

SUMMARY OF THE INVENTION

The conventional image formation apparatus, however, starts driving the photosensitive drum or the image transfer roller at the same time as the feeding of a sheet from a sheet feeder cassette. Accordingly, the photosensitive drum or the image transfer roller of the conventional image formation apparatus, in some cases, lacks a sufficient service life.

An aspect of the invention is an image formation apparatus including: an image carrier on which a developer image is to be formed; an image transfer device configured to transfer the developer image formed on the image carrier to a medium at an image transfer position; a controller configured to control drive of the image carrier and the image transfer device; a first medium feeder configured to feed the medium to the image transfer position along a medium conveyance path extending from the first medium feeder to the image transfer position; and a medium detector provided between the first medium feeder and the image transfer position in the medium conveyance path. The controller is configured to control the drive of the image carrier on the basis of a medium-detection result by the medium detector.

Another aspect of the invention is an image formation apparatus including: an image carrier on which a developer image is formed; an image transfer device configured to transfer the developer image formed on the image carrier to a medium; a controller configured to control drive of the image carrier and the image transfer device; a first medium feeder configured to feed the medium in the medium-conveyance direction to convey the medium to the image transfer device; a medium-size detector configured to detect a conveyance-direction dimension of the medium; and a leading-end detector provided at a first distance from the image transfer device in a downstream direction and configured to detect the leading end of the medium discharged from the image transfer device. The controller is configured to stop driving the image carrier when the medium is conveyed over a distance determined by subtracting the first distance from the conveyance-direction dimension after the leading-end detector detects the leading end of the medium.

DETAILED DESCRIPTION OF EMBODIMENTS

Figure 1:
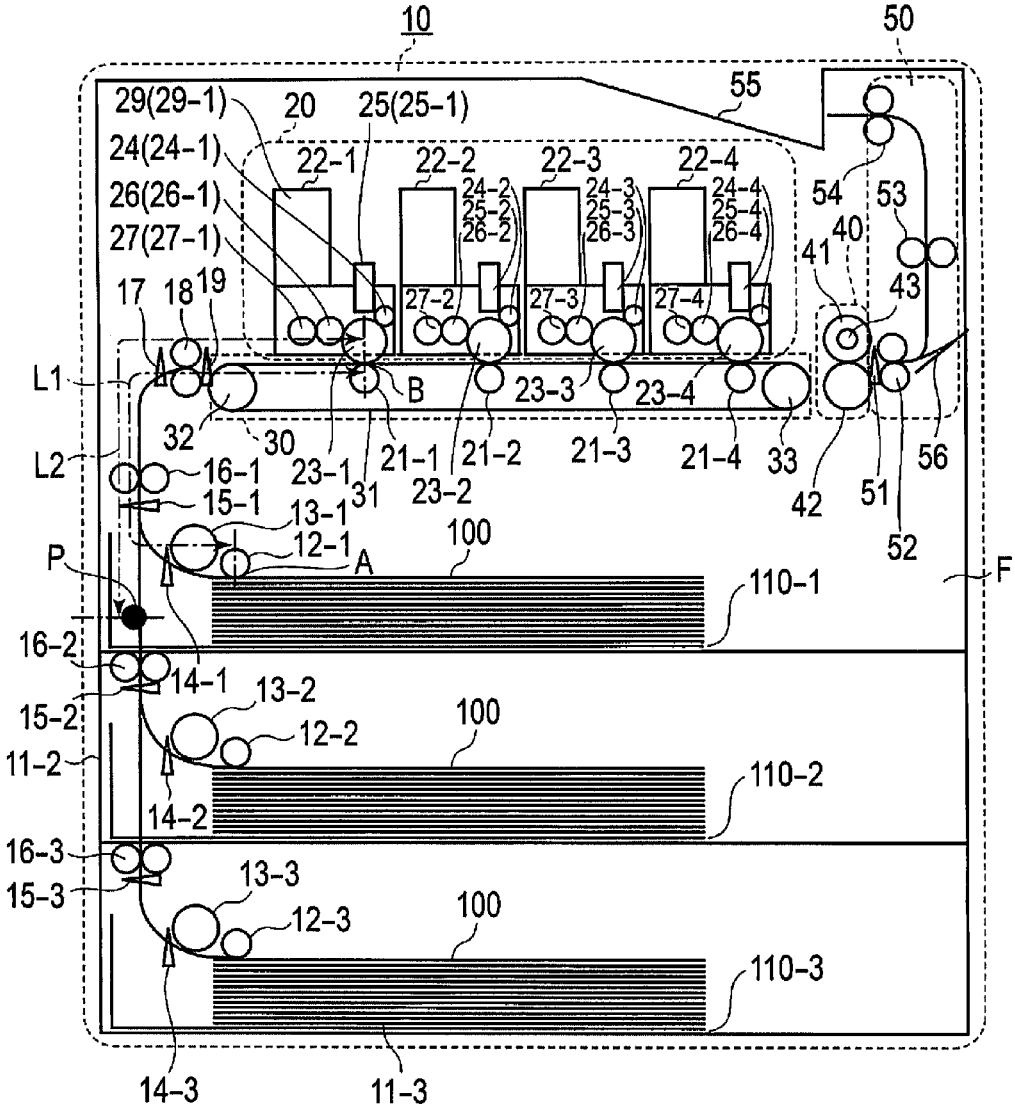
FIG. 1 is a schematic diagram illustrating the configuration of an image formation apparatus according to a first embodiment of the invention.

Descriptions are provided hereinbelow for embodiments based on the drawings. In the respective drawings referenced herein, the same constituents are designated by the same reference numerals and duplicate explanation concerning the same constituents is omitted. All of the drawings illustrate the respective examples only.

First Embodiment

Configuration of First Embodiment

FIG. 1 is a schematic diagram illustrating the configuration of image formation apparatus 10 according to a first embodiment of the invention.

Image formation apparatus 10 is a printer of a tandem type. Image formation apparatus 10 includes a main body including medium feeder F, as well as first optional tray 11-3 and second optional tray 11-2 that are additionally provided to the image formation apparatus main body. Thus, medium feeders of image formation apparatus 10 include: medium feeder F as a third medium feeder that image formation apparatus 10 is originally equipped with and provided in a bottom portion of the main body of image formation apparatus 10; second optional tray 11-2 as a second medium feeder that is additionally provided below medium feeder F of the image formation apparatus main body; and first optional tray 11-3 as a first medium feeder that is additionally provided below second optional tray 11-2.

The main body of image formation apparatus 10 includes medium feeder F, image formation section 20, fixation unit 40, discharger unit 50, and stacker 55 or face-up stacker 56. Medium feeder F is configured to feed print medium 100, which may be a recording sheet. Image formation section 20 is configured to form a toner image as a developer image. Fixation unit 40 is configured to fix the toner image to a surface of print medium 100. Discharger unit 50 is configured to discharge print medium 100. Stacker 55 or face-up stacker 56 is configured to contain discharged print medium 100. In addition, image formation apparatus 10 includes various motors that are configured to rotate the rollers and the like (described later) and various clutches configured to turn ON and OFF the transmission of power to the rollers provided in a medium conveyance path. Furthermore, image formation apparatus 10 includes high-voltage power supply 63 and a low-voltage power supply. High-voltage power supply 63 shown in FIG. 3 and described later supplies high voltages ranging from 200V to 5000V to charger roller 24, image transfer roller 21, and the like in image formation unit 22. The low-voltage power supply supplies DC electric power with voltages of 5 V, 24 V, and the like to the circuits and motors.

Medium feeder F of the image formation apparatus main body is detachably set in a lower portion of the main body of image formation apparatus 10. Medium feeder F includes sheet cassette 110-1, pick-up roller 12-1, sheet-feeder roller 13-1, sheet-feed sensor 14-1, first IN-sensor 15-1, second IN-sensor 17, WR sensor 19, first resist-roller pair 16-1, and second resist-roller pair 18. Sheet cassette 110-1 as a medium storage detachably set in a lower potion of the main body of image formation apparatus 10 is capable of storing print media 100 therein. Pick-up roller 12-1 works together with a blade-shaped separator or the like to pick up print media 100 one by one from sheet cassette 110-1. Sheet-feeder roller 13-1 is configured to feed print medium 100 thus taken out of the sheet cassette 110-1. Sheet-feed sensor 14-1 is configured to judge whether print medium 100 is fed. First IN-sensor 15-1, second IN-sensor 17, and WR sensor 19 are configured to judge the position of print medium 100. First resist-roller pair 16-1 and second resist-roller pair 18 are configured to convey print media 100 to image formation section 20.

Second optional tray 11-2 as a second medium feeder, includes sheet cassette 110-2, pick-up roller 12-2, sheet-feeder roller 13-2, sheet-feed sensor 14-2, conveyance sensor 15-2, and conveyance rollers 16-2. Sheet cassette 110-2 as a medium storage is capable of storing print media 100 therein. Pick-up roller 12-2 works together with a blade-shaped separator to pick up print media 100 one by one from sheet cassette 110-2. Sheet-feeder roller 13-2 is configured to feed print medium 100 thus taken out of the sheet cassette 110-2. Sheet-feed sensor 14-2 is configured to judge whether print medium 100 is fed. Conveyance sensor 15-2 is configured to judge the position of print medium 100. Conveyance rollers 16-2 are configured to convey print medium 100 to image formation apparatus 10.

First optional tray 11-3 (serving as a first medium feeder) has a configuration that is similar to the configuration of second optional tray 11-2.

Each of sheet cassettes 110 (=110-1 to 110-3) can store a plurality of print media 100 therein. Print media 100 is used to print either monochrome or color images, and have various predetermined sizes. For example, print media 100 is a sheet of high-quality paper, recycled paper, gloss paper, or matte paper. In addition, an OHP (over head projector) film may also be used as print media 100.

Pick-up rollers 12 (=12-1 to 12-3) are provided respectively in medium feeder F of the main body of image formation apparatus 10, in second optional tray 11-2, and in first optional tray 11-3. Each pick-up roller 12 is capable of rotating while being pressed onto the top surface of the stacked print media 100. In the medium conveyance path, sheet-feeder rollers 13 (=13-1 to 13-3) are provided downstream of their corresponding pick-up rollers 12 (=12-1 to 12-3). In addition, sheet-feed sensors 14 (=14-1 to 14-3) are provided downstream of their corresponding sheet-feeder rollers 13 (=13-1 to 13-3).

Inside the medium feeder F, first IN-sensor 15-1 is provided downstream of sheet-feed sensor 14-1 along the medium conveyance path in a manner that first IN-sensor 15-1 can detect print medium 100. Downstream of first IN-sensor 15-1, first resist-roller pair 16-1, second IN-sensor 17, second resist-roller pair 18, and WR sensor 19 are provided in this order.

Inside second optional tray 11-2, which is provided at the upstream side of medium feeder F, conveyance sensor 15-2 is provided downstream of sheet-feed sensor 14-2 along the medium conveyance path in a manner that conveyance sensor 15-2 can detect print medium 100. In the medium conveyance route, conveyance sensor 15-2 is provided at a substantially linear section of the medium conveyance path where print medium 100 is conveyed stably. Conveyance rollers 16-2 are provided downstream of conveyance sensor 15-2. Conveyance rollers 16-2 of second optional tray 11-2 convey print medium 100 towards image formation section 20 through medium feeder F of the main body of image formation apparatus 10. To put it differently, the downstream side of conveyance rollers 16-2 of second optional tray 11-2 is connected to an upstream-side position of first IN-sensor 15-1 and first resist-roller pair 16-1 provided in medium feeder F of the main body of image formation apparatus 10.

Conveyance sensor 15-3 is provided along the medium conveyance path in the first optional tray 11-3 and downstream of sheet-feed sensor 14-3 in a manner that conveyance sensor 15-3 can detect print medium 100. Conveyance rollers 16-3 are provided downstream of the conveyance sensor 15-3. Conveyance rollers 16-3 convey print medium 100 via conveyance sensor 15-2 and conveyance rollers 16-2 provided in second optional tray 11-2 to the position of first IN-sensor 15-1 and first resist-roller pair 16-1 provided in medium feeder F of the main body of image formation apparatus 10.

Image formation section 20 of the main body of image formation apparatus 10 includes four image formation units 22 (=22-1 to 22-4) arranged in the order of of black (K), yellow (Y), magenta (M), and cyan (C) from the left hand side of FIG. 1. Image formation section 20 also includes image transfer rollers 21 (=21-1 to 21-4) respectively including photosensitive drums 23-1 to 23-4 provided therebelow. Medium conveyance mechanism 30 is provided below image formation section 20. Medium conveyance mechanism 30 includes driven roller 32, belt drive roller 33, and conveyor belt 31 for medium conveyance wound across driven roller 32 and belt drive roller 33. Belt drive roller 33 is configured to drive conveyor belt 31. Driven roller 32, on the other hand, rotates along with the rotation of conveyor belt 31 and rotates conveyor belt 31.

Each of four image formation units 22 respectively corresponding to black (K), yellow (Y), magenta (M), and cyan (C) includes photosensitive drum 23, charger roller 24, light-emitting diode (hereinafter referred to as LED) head 25, development roller 26, developer supply roller 27, developer storage cartridge 29, an unillustrated toner regulation member, and cleaning blade 28. Photosensitive drum 23 is configured to carry an electrostatic latent image based on image information. Charger roller 24 is configured to charge photosensitive drum 23. LED head 25 is configured to irradiate the surface of photosensitive drum 23 with light based on the image information. Development roller 26 is configured to develop the electrostatic latent image on the photosensitive drum 2 by using toner as the developer. Developer supply roller 27 is configured to supply the toner to development roller 26. Developer storage cartridge 29 can be detachably set in image formation unit 22. Cleaning blade 28 shown in FIG. 2 (described in detail later) is configured to scrape off the toner remaining on the surface of the photosensitive drum 23. Between each of photosensitive drums 23 (=23-1 to 23-4) and the corresponding one of image transfer rollers (=21-1 to 21-4), the upper line of conveyor belt 31 of medium conveyance mechanism 30 and is in contact with the image carriers and with the image transfer devices. Conveyor belt 31 rotates to convey print medium 100 to the nip portions between photosensitive drums 23 (=23-1 to 23-4) and image transfer rollers 21 (=21-1 to 21-4) one after another. Image formation section 20 serves as a development device configured to develop toner image on print medium 100.

Fixation unit 40 includes fixation roller 41, back-up roller 42, and heater 43. Heater 43, which is provided in fixation roller 41, is a halogen lamp or the like. Fixation unit 40 serving as a fixation device is configured to apply heat and pressure to print medium 100, thereby fixing the toner image.

Discharger unit 50 includes EXIT sensor 51 as a leading-end detector and pairs of discharger rollers 52 to 54. EXIT sensor 51 is positioned downstream of image formation unit 22-4 provided on the most downstream side among the four image formation units 22 in the image formation section 20. EXIT sensor 51 and image formation unit 22-4 are separated away from each other by a first distance. EXIT sensor 51 thus positioned detects discharge of print medium 100 from image formation section 20. Pairs of discharger rollers 52 to 54 are provided downstream of fixation unit 40 along the medium conveyance path so as to nip print medium 100. Unillustrated motors drive these pairs of discharger rollers 52 to 54.

Incidentally, point P between conveyance rollers 16-2 and first IN-sensor 15-1 in FIG. 1 is the most downstream position of print medium 100 in a zone that allows the toner-image transfer at image transfer position B to be performed in time. To put it differently, point P is located immediately before a zone that does not allow any more the toner-image transfer at image transfer position B to be performed in time. Hence, if the image formation process to form a toner image on the surface of photosensitive drums 23-1 is started while print medium 100 is being conveyed on the downstream side of this point P in the medium conveyance path, the toner image fails to reach image transfer position B in time for the arrival of print medium 100 at image transfer position B. This means that the toner image fails to get ready for the toner-image transfer operation that occurs at image transfer position B. In contrast, if the image formation process to form a toner image is started while print medium 100 is still being conveyed at the upstream side of this point P in the medium conveyance path, the arrival of the toner image at image transfer position B can be synchronized with the arrival of print medium 100 at image transfer position B. This means that the toner image is ready for the toner-image transfer operation to be performed at image transfer position B.

When distance L2 shown in FIG. 1 represents the distance between point P and the most upstream image transfer position B (i.e., nip B between the most upstream photosensitive drum 23-1 and the most upstream image transfer roller 21-1), and distance L1 represents the distance between the most upstream image transfer position B (the most upstream nip B) and contact point A where pick-up roller 12-1 of medium feeder F is in contact with print medium 100, preferably, L1=L2.

Figure 2:
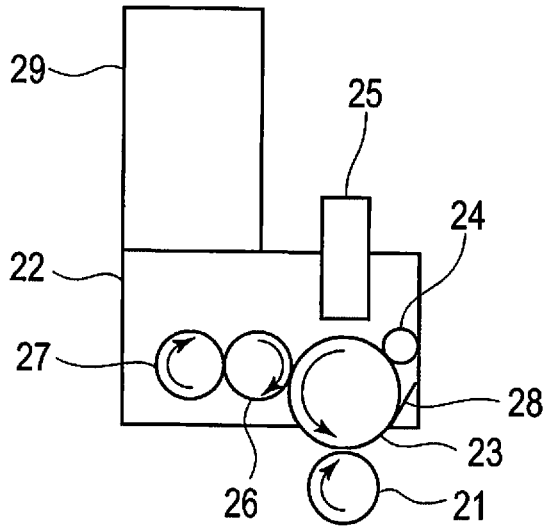
FIG. 2 is a schematic diagram illustrating the configuration of an image formation unit of the image formation apparatus shown in FIG. 1.

FIG. 2 is a schematic diagram illustrating the configuration of image formation unit 22 of image formation apparatus 10 shown in FIG. 1.

Each of image formation units 22 includes photosensitive drum 23, charger roller 24, LED head 25, development roller 26, supply roller 27, developer storage cartridge 29, and cleaning blade 28. Charger roller 24 is pressed onto photosensitive drum 23. LED head 25 is provided above photosensitive drum 23. Development roller 26 contacts photosensitive drum 23. Supply roller 27 is in contact with development roller 26. Developer storage cartridge 29 is provided above supply roller 27. Cleaning blade 28 contacts the surface of photosensitive drum 23.

Photosensitive drum 23 includes a conductive base layer made of aluminum or the like. Photosensitive drum 23 also includes a photosensitive layer formed on the conductive base layer and including a photoconductive layer and a charge transportation layer. Photosensitive drum 23 has a cylindrical shape, and is supported rotatably. Photosensitive drum 23 is in contact with charger roller 24, with image transfer roller 21, and with development roller 26. In addition, the leading end portion of cleaning blade 28 contacts the photosensitive drum 23. Electrical charges are accumulated on the surface of the photosensitive drum 23, and thereby photosensitive drum 23 serves as an image carrier that is configured to carry a toner image. Photosensitive drum 23 rotates anticlockwise in FIG. 2. Components of each image formation unit 22 are described below in an order of the rotation of photosensitive drum 23.

Charger roller 24 is made of a conductive metal shaft coated with a semiconductor rubber such as silicone rubber, has a cylindrical shape, is supported rotatably, and is pressed onto photosensitive drum 23. Charger roller 24 is electrically charged by high-voltage power supply 63 shown in FIG. 3 and described later. Charger roller 24 rotates while being pressed onto photosensitive drum 23, and thereby applies a predetermined voltage to photosensitive drum 23. Consequently, the surface of photosensitive drum 23 accumulates electrical charges uniformly.

LED head 25 includes LEDs, a lens array, and an LED driver element and is provided above photosensitive drum 23. LED head 25 radiates light based on the image information onto the surface of photosensitive drum 23, and thereby serves as a light-exposure device that is configured to form an electrostatic latent image on the surface of the photosensitive drum 23.

Supply roller 27 is made of a conductive metal shaft coated with rubber. Supply roller 27 has a cylindrical shape and is in contact with development roller 26. Supply roller is electrically charged by high-voltage power supply 63 shown in FIG. 3 and described later. Supply roller 27 is pressed onto development roller 26, and thereby supplies toner to development roller 26.

Development roller 26 is made of a conductive metal shaft coated with a semiconductor urethane rubber material or the like and has a cylindrical shape. Development roller 26 is in contact with photosensitive drum 23 and the leading end portion of the unillustrated toner regulation member at the circumferential surface. Development roller 26 is electrically charged by high-voltage power supply 63 shown in FIG. 3 and described later. Development roller 26 is pressed onto supply roller 27, and thereby toner is supplied to the developer roller 26.

The unillustrated toner regulation member is made of stainless steel or the like and has a plate shape. The toner regulation member has a leading end portion that contacts the surface of development roller 26. The toner regulation member scrapes off the excess portion of a predetermined amount of the toner on the surface of development roller 26. Thus, the toner regulation member regulates the thickness of the toner on the surface of the development roller 26 in a manner that a toner layer with a uniform thickness can always be formed on the surface of the development roller 26.

Cleaning blade 28 is made of a rubber material or the like and has a plate shape. Cleaning blade 28 is provided so that the leading end portion of cleaning blade 28 contacts the surface of photosensitive drum 23. After the toner image formed on the surface of photosensitive drum 23 is transferred to the surface of print medium 100, cleaning blade 28 cleans the surface of photosensitive drum 23 by scraping off the toner remaining on the surface.

Figure 3:
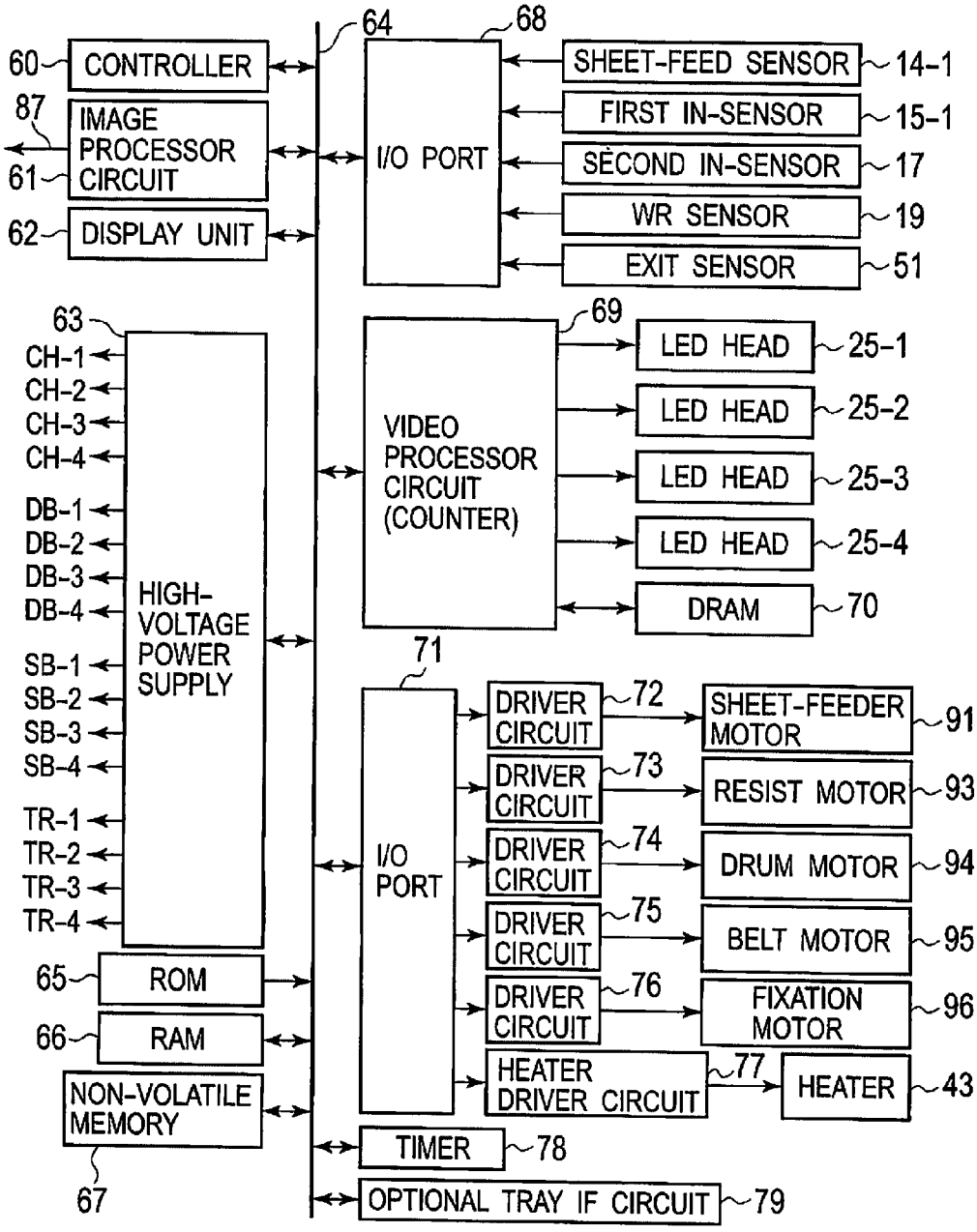
FIG. 3 is a diagram illustrating the circuit configuration of the image formation apparatus shown in FIG. 1.

FIG. 3 is a diagram illustrating the circuit configuration of image formation apparatus 10 shown in FIG. 1.

Image formation apparatus 10 includes controller 60, image processor circuit 61 as a medium-size detector, display unit 62, high-voltage power supply 63, controller line 64, read only memory (hereinafter abbreviated as "ROM") 65, random access memory (hereinafter abbreviated as "RAM") 66, non-volatile memory 67, input-output port (hereinafter simply referred to as "I/O port") 68, video processor circuit (hereinafter referred to as "VIDEO processor circuit") 69 including a counter, dynamic random access memory (hereinafter abbreviated as "DRAM") 70, I/O port 71, driver circuits 72 to 76, heater driver circuit 77, timer 78 as a charge-voltage judgment portion, optional tray interface circuit (hereinafter simply referred to as "optional tray IF circuit") 79, sheet-feed sensor 14-1, first IN-sensor 15-1, second IN-sensor 17, WR sensor 19, EXIT sensor 51, LED heads 25 (=25-1 to 25-4), heater 43, sheet-feeder motor 91, resist motor 93, drum motor 94, belt motor 95, and fixation motor 96.

Controller 60 is connected, via controller line 64, to image processor circuit 61, display unit 62, high-voltage power supply 63, ROM 65, RAM 66, non-volatile memory 67, I/O port 68, VIDEO processor circuit 69, I/O port 71, timer 78, and optional tray IF circuit 79.

I/O port 68 is connected to sheet-feed sensor 14-1, first IN-sensor 15-1, second IN-sensor 17, WR sensor 19, and EXIT sensor 51. VIDEO processor circuit (counter) 69 is connected to LED heads 25 (=25-1 to 25-4) and DRAM 70.

I/O port 71 is connected to sheet-feeder motor 91 via driver circuit 72, and is also connected to resist motor 93 via driver circuit 73. In addition, I/O port 71 is connected to drum motor 94 via driver circuit 74, and is also connected to belt motor 95 via driver circuit 75. Moreover, I/O port 71 is connected to fixation motor 96 via driver circuit 76, and is also connected to heater 43 via heater driver circuit 77.

Controller 60 is configured to entirely control image formation apparatus 10. By monitoring the detection results of sensors 14, 15, 17, 19, and 51, controller 60 controls the driving of, and the application of voltages to, rollers 12, 13, 16, 18, 52, 53, and 54, as well as fixation unit 40, photosensitive drum 23, image transfer roller 21, and conveyor belt 31. In addition, controller 60 controls the image formation process. Image processor circuit 61 is configured to take in image data sent via control signal line 87 as a connection device from a host or an external image transfer apparatus that is connected to image formation apparatus 10 and convert the image data into a printable data format. Display unit 62 is configured to monitor the state of image formation apparatus 10, and to prompt the user to take appropriate actions. ROM 65 is configured to store control programs that are necessary for the operation of this first embodiment. RAM 66 serves as a working memory for the control programs of this first embodiment. Non-volatile memory 67 is configured to store information which is needed for the control of this first embodiment and which must be kept even after image formation apparatus 10 is powered OFF.

I/O port 68 monitors the states of sheet-feed sensor 14-1, first IN-sensor 15-1, second IN-sensor 17, WR sensor 19, EXIT sensor 51, and other unillustrated sensors. VIDEO processor circuit 69 is configured to output the image data that have been converted by image processor circuit 61 to LED heads 25 as the light-exposure devices. In addition, VIDEO processor circuit 69 is configured to count, by using DRAM 70, the number of dots that are outputted (emitted) in the printing. DRAM 70 is configured to store temporarily the image data outputted by image processor circuit 61.

I/O port 71 is configured to output, to driver circuits 72 to 76, control signals that make these driver circuits 72 to 76 drive sheet-feeder motor 91, resist motor 93, belt motor 95, drum motor 94, and fixation motor 96. I/O port 71 also outputs, to heater driver circuit 77, a control for driving heater 43 of fixation unit 40. Timer 78 is configured to perform timer processes that are necessary for the controls.

High-voltage power supply 63 is configured to output high-voltage signals that are necessary for image formation. High-voltage power supply 63 is configured to output voltages CH-1 to CH-4 applied respectively to charger rollers 24-1 to 24-4, voltages DB-1 to DB-4 applied respectively to development rollers 26-1 to 26-4, output voltages SB-1 to SB-4 applied respectively to supply rollers 27-1 to 27-4 and output voltages TR-1 to TR-4 applied respectively to image transfer rollers 21-1 to 21-4. Optional tray IF circuit 79 is configured to communicate with each of optional trays 11 (first optional tray 11-3 and second optional tray 11-2 in this embodiment) shown in FIG. 4 and described later.

Figure 4:
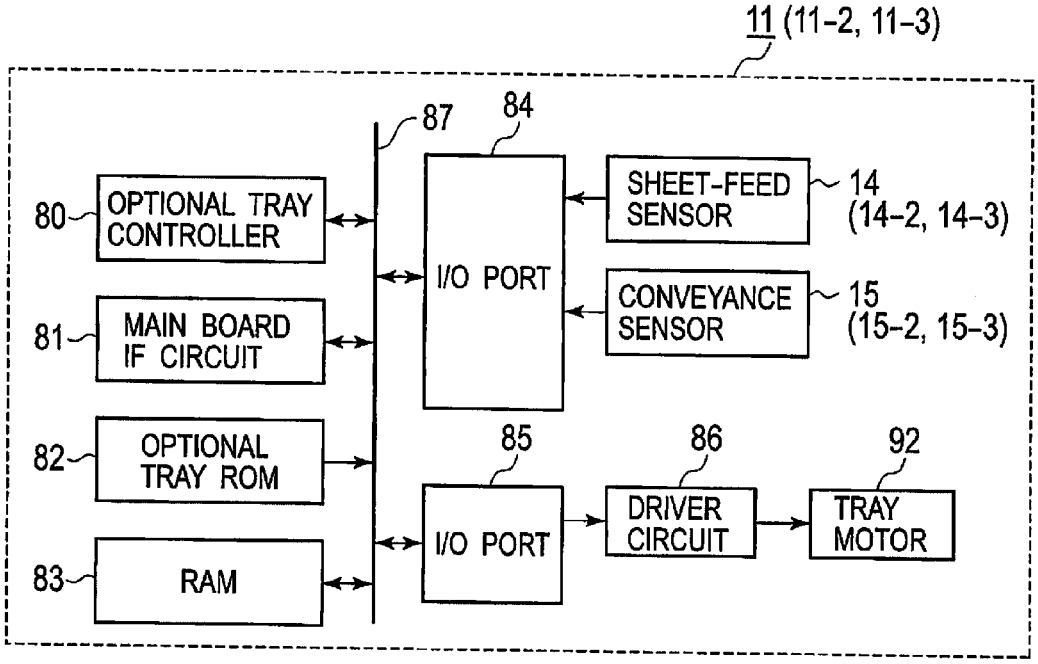
FIG. 4 is a diagram illustrating the circuit configuration of an optional tray of the image formation apparatus shown in FIG. 1.

FIG. 4 is a diagram illustrating the circuit configuration of optional tray 11 of image formation apparatus 10 shown in FIG. 1.

Each of optional trays 11 (first optional tray 11-3 and second optional tray 11-2 in first embodiment) includes optional tray controller 80, main board interface circuit (herein after, simply referred to as "main board IF circuit") 81, optional tray ROM 82, RAM 83, I/O ports 84 and 85, driver circuit 86, sheet-feed sensor 14 (14-2 or 14-3), conveyance sensor 15 (15-2 or 15-3), tray motor 92, and control signal line 87.

Optional tray controller 80 is connected, via control signal line 87, to main board IF circuit 81, optional tray ROM 82, and I/O ports 84 and 85. I/O port 84 is connected to sheet-feed sensor 14 and conveyance sensor 15. I/O port 85 is connected to tray motor 92 via driver circuit 86.

Optional tray controller 80 is configured to perform overall control of optional tray 11. Main board IF circuit 81 is communicably connected to optional tray IF circuit 79 of image formation apparatus 10.

Optional tray ROM 82 is configured to store programs that are used to control optional tray 11. I/O port 84 is configured to monitor sheet-feed sensor 14 and conveyance sensor 15 in optional tray 11. I/O port 85 is configured to output, to driver circuit 86, control signals for driving tray motor 92.

A circuit board of optional tray 11 is mounted in each of second and first optional trays 11-2 and 11-3. The circuit boards of second and first optional trays 11-2 and 11-3 are capable of communicating individually with controller 60 of the main body of image formation apparatus 10.

Operations of Comparative Example

Case of Using Medium Feeder F of Image Formation Apparatus Main Body

By referring to FIG. 1, description is given of the operations of a comparative example of a case where print medium 100 is fed from medium feeder F of the main body of image formation apparatus 10.

Print medium 100 is conveyed from the upstream side to the downstream side along the medium conveyance path. Sheet cassette 110-3 is located at the upstream end of the medium conveyance path whereas stacker 55 is located at the downstream end of the medium conveyance path.

Image formation apparatus 10 is connected to a host computer or an external apparatus (not illustrated) via a cable or wirelessly. When image formation apparatus 10 receives, from the host computer or the external apparatus, print data and an instruction to make the printing using print media 100 stored in medium feeder F of the main body of image formation apparatus 10, image formation apparatus 10 makes sheet-feeder motor 91 rotate pick-up roller 12-1 and sheet-feeder roller 13-1. With the rotation of pick-up roller 12-1, each of print media 100 is separated from the others. Then, print media 100 thus separated are sent one by one to the downstream side of the medium conveyance path.

Print medium 100 sent from pick-up roller 12-1 is further conveyed by sheet-feeder roller 13-1. Note that the driving of resist motor 93, belt motor 95, drum motor 94, and fixation motor 96 is started substantially at the same time as the driving of sheet-feeder motor 91.

Print medium 100 that has been conveyed by the drive force of sheet-feeder motor 91 is then conveyed substantially at the same speed by first resist-roller pair 16-1 and then by second resist-roller pair 18. To this end, resist motor 93 is rotated substantially at the same speed beforehand.

In addition, the image formation process is started by the charging operation to electrically charge the surface of photosensitive drum 23 as the image carrier at a certain potential or even higher. Hence, photosensitive drums 23 and conveyor belt 31 are made to rotate at the same speed by drum motor 94 and belt motor 95, respectively.

Note that, if the temperature of fixation roller 41 is at a target temperature, the driving of fixation motor 96 is started substantially at the same time as the feeding of print medium 100 is started as described earlier. If, conversely, the temperature of fixation roller 41 is lower than the target temperature, the driving of fixation motor 96 is started before the feeding of print medium 100 is started to warm up fixation roller 41.

Once sheet-feed sensor 14-1 detects that print medium 100 is fed properly, butting control to correct skew of print medium 100 is performed by using first IN-sensor 15-1 and first resist-roller pair 16-1. While skew is corrected, the drive force of resist motor 93 is cut off by an unillustrated drive-force transmission device. When the butting action of a predetermined amount is completed, the drive-force transmission device is switched to a transmission state, and thus the conveyance of print medium 100 is resumed.

Print medium 100 passes through second IN-sensor 17, and then is conveyed to second resist-roller pair 18. Print medium 100 is then conveyed by second resist-roller pair 18 to pass through WR sensor 19, and then gets on top of conveyor belt 31 to be conveyed by conveyor belt 31.

To be more specific, print medium 100 turns ON WR sensor 19, and then is conveyed to conveyor belt 31 located downstream in the medium conveyance path. A certain time after WR sensor 19 is turned ON, LED heads 25 of image formation units 22 of black (K), yellow (Y), magenta (M), and cyan (C) start radiating light to form electrostatic latent images of their respective colors on their respective photosensitive drums 23.

Belt drive roller 33 rotates to drive the conveyor belt 31 wound across belt drive roller 33 and the driven roller 32 to rotate along the medium conveyance path. Print medium 100 is conveyed by the driving of conveyor belt 31 sequentially to the four image formation units 22 (=22-1 to 22-4) arranged in the order of black (K), yellow (Y), magenta (M), and cyan (C).

Photosensitive drum 23 of each of the four image formation units 22 of black (K), yellow (Y), magenta (M), and cyan (C) rotates anticlockwise, and the surface of each photosensitive drum 23 is uniformly charged by the corresponding charger roller 24. Each uniformly charged photosensitive drum 23 is then irradiated with light based on the image data received from the host computer or the external apparatus radiated by LED head 25. Thus, an electrostatic latent image is formed on photosensitive drum 23. Photosensitive drum 23 with the electrostatic latent image formed on the surface is then subjected to a development of the toner image performed by supply roller 27 and development roller 26. Image transfer roller 21 and photosensitive drum 23 sandwich (nip) therebetween print medium 100 and conveyor belt 31 and convey print medium 100. A voltage of approximately +3000 V that is applied to each image transfer roller 21 attracts, to print medium 100, the toner on the surface of photosensitive drum 23. Thereby each toner image is transferred to the surface of print medium 100. Print medium 100 with the transferred toner images is then sent to fixation unit 40. The toner remaining on photosensitive drum is scraped off by cleaning blade 28, and thus photosensitive drum 23 is made ready for the formation of another toner image.

The image formation process includes: a step of electrically charging the surface of photosensitive drum 23 by charger roller 24; irradiating the surface of photosensitive drum 23 with light radiated by LED head 25 to form an electrostatic latent image on the surface of photosensitive drum 23; developing the electrostatic latent image formed on the surface of photosensitive drum 23 as the image carrier by development roller 26 to form a toner image on the surface of photosensitive drum 23; and transferring the toner image formed on the surface of photosensitive drum 23 to the surface of print medium 100 by image transfer roller 21.

After toner images of the four colors of black (K), yellow (Y), magenta (M), and cyan (C) are transferred to the surface of print medium 100, print medium 100 is conveyed to fixation unit 40. In fixation unit 40, print medium 100 is nipped by and conveyed through nip portion formed by fixation roller 41 and back-up roller 42. In the nip portion, the heat from fixation roller 41 and the pressure caused by the biasing force of back-up roller 42 are applied to print medium 100. Thus, the toner is melted and the toner images are fixed to the surface of print medium 100.

After the toner images are fixed to the surface of print medium 100, the leading end of print medium 100 is detected by EXIT sensor 51. Then, print medium 100 is conveyed by the rotations of pairs of discharger rollers 52 to 54. A predetermined time after print medium 100 passes through EXIT sensor 51, belt motor 95 and drum motor 94 are stopped. A predetermined time after that, fixation motor 96 is stopped.

Print medium 100 thus conveyed is then discharged to stacker 55 or face-up stacker 56 through a discharge route selected by the user.

Operations of Comparative Example

Case of Using First Optional Tray 11-3

By referring to FIG. 1, description is given of the operations of the comparative example of a different case where print medium 100 is fed from first optional tray 11-3 of image formation apparatus 10.

Firstly, image formation apparatus 10 receives, from an external apparatus or a host computer (not illustrated), print data and an instruction to perform the printing using print media 100 stored in first optional tray 11-3. Then, image formation apparatus 10 makes first-optional-tray motor 92-3 rotate pick-up roller 12-3 and sheet-feeder roller 13-3. With the rotations of pick-up roller 12-3, each of print media 100 is separated from the others. Then, the print media 100 thus separated are sent, one by one, to the downstream side of the medium conveyance path.

After print medium 100 passes through pick-up roller 12-3, sheet-feeder roller 13-3 further conveys print medium 100. Note that the driving of resist motor 93, belt motor 95, drum motor 94, fixation motor 96, and second-optional-tray motor 92-2 is started substantially at the same time as the driving of first-optional-tray motor 92-3 is started.

The image formation process is started by the start of the charging operation to electrically charge the surface of photosensitive drums 23 at a certain potential or higher.

Note that, if the temperature of fixation roller 41 is at a target temperature, the driving of fixation motor 96 is started substantially at the same time as the feeding of print medium 100 is started as described earlier. If, conversely, the temperature of fixation roller 41 is lower than the target temperature, the driving of fixation motor 96 is started before the feeding of print medium 100 is started to warm up fixation roller 41.

When sheet-feed sensor 14-3 detects that print medium 100 is fed properly, butting control to correct skew of print medium 100 is performed by using conveyance sensor 15-3 and conveyance rollers 16-3. Print medium 100 passes through conveyance sensor 15-2 as a medium detector, conveyance rollers 16-2, first IN-sensor 15-1, first resist-roller pair 16-1, and second IN-sensor 17 to be conveyed to second resist-roller pair 18. After print medium 100 is conveyed to second resist-roller pair 18, print medium 100 passes through WR sensor 19, and then gets on top of conveyor belt 31 to be further conveyed by conveyor belt 31.

The operations performed thereafter are the same as those performed in the case where print medium 100 is fed from medium feeder F of the main body of image formation apparatus 10. Print medium 100 turns ON WR sensor 19, and then is conveyed to conveyor belt 31 located downstream of WR sensor 19 in the medium conveyance path. Then, print medium 100 is conveyed sequentially to the four image formation units 22 of black (K), yellow (Y), magenta (M), and cyan (C) arranged in this order.

Toner images of the four colors are conveyed to print medium 100 by the four image formation units 22, and then the toner images are fixed by fixation unit 40.

After the toner images are fixed to the surface of print medium 100, the leading end of print medium 100 is detected by EXIT sensor 51, and print medium 100 is conveyed by the rotations of pairs of discharger rollers 52 to 54. A predetermined time after print medium 100 passes through EXIT sensor 51, belt motor 95 and drum motor 94 are stopped. A predetermined time after that, fixation motor 96 is stopped. Print medium 100 thus conveyed is then discharged to stacker 55 or face-up stacker 56 through a discharge route selected by the user.

Operations of First Embodiment

A feature of the first embodiment lies in the control method of a case where print medium 100 is conveyed over a long distance. So, the following description is given of the operations of a case where print medium 100 is fed from first optional tray 11-3. Note that the operations of the first embodiment is also applicable to a case where print medium 100 is fed from second optional tray 11-2. If print medium 100 fed from medium feeder F has to be conveyed over a long distance, the operations of the first embodiment is also applicable to a case where print medium 100 is fed from medium feeder F.

Image formation apparatus 10 receives, from an unillustrated external apparatus, print data and an instruction to perform the printing using print media 100 stored in first optional tray 11-3. Then, image formation apparatus 10 makes first-optional-tray motor 92-3 rotate pick-up roller 12-3 and sheet-feeder roller 13-3. With the rotation of pick-up roller 12-3, each of print media 100 is separated from the others. Then, the print media 100 thus separated are sent, one by one, to the downstream side of the medium conveyance path.

In this first embodiment, on the basis of the print data sent from the host computer or the external apparatus, image processor circuit 61 as a size detector detects the conveyance-direction dimension of print medium 100.

After print medium 100 passes through pick-up roller 12-3, sheet-feeder roller 13-3 further conveys print medium 100. Note that in this first embodiment, the driving of resist motor 93, fixation motor 96, and second-optional-tray motor 92-2 is started substantially at the same time as the driving of first-optional-tray motor 92-3. Unlike the comparative example, the driving of neither belt motor 95 nor drum motor 94 is started at that timing.

The rotations of neither belt motor 95 nor drum motor 94 of this first embodiment are started substantially at the same time as the rotations of first-optional-tray motor 92-3 are started because first optional tray 11-3 is provided at the upstream side, in the medium-conveyance direction, of point P as the most downstream position for print medium 100 within the zone that allows the toner-image transfer at image transfer position B to be performed in time. Thus, the distance from this first optional tray 11-3 to image transfer position B is long. Accordingly, at the time when the feeding of print medium 100 from first optional tray 11-3 is started, the position of print medium 100 while being conveyed in the medium-conveyance path is still within a zone that allows the toner-image transfer at image transfer position B to be performed in time. The above-mentioned zone that allows the toner-image transfer at image transfer position B to be performed in time refers to a position that satisfies the following condition. The distance measured along the medium-conveyance path from each of the positions to image transfer position B of the most upstream image formation unit 22-1 is not shorter than the distance by which photosensitive drum 23 rotates for a period starting from the beginning of the image formation process to form a toner image on the surface of photosensitive drums 23-1 and ending with the transferring of the toner image thus formed onto the surface of print medium 100 at image transfer position B.

Note that, if the temperature of fixation roller 41 is at the target temperature, the driving of fixation motor 96 is started substantially at the same time as the feeding of print medium 100 is started as described earlier. If, conversely, the temperature of fixation roller 41 is lower than the target temperature, the driving of fixation motor 96 is started before the feeding of print medium 100 is started to warm up fixation roller 41.

When sheet-feed sensor 14-3 detects that print medium 100 is fed properly, butting control to correct skew of print medium 100 is performed by using conveyance sensor 15-3 and conveyance rollers 16-3. Print medium 100 passes through conveyance sensor 15-2, conveyance rollers 16-2, first IN-sensor 15-1, first resist-roller pair 16-1, and second IN-sensor 17. Then, print medium 100 is conveyed to second resist-roller pair 18.

In this first embodiment, when conveyance sensor 15-2 detects the leading end of print medium 100, controller 60 makes optional tray controller 80 of second optional tray 11-2 count the number of drive pulses outputted from the detection position through I/O port 85 to driver circuits 86-2 of second-optional-tray motor 92-2. With this counting, the driving of drum motor 94 and belt motor 95 is started at the time when the distance from the leading end of print medium 100 to the position of nip portion B (i.e., image transfer position) between photosensitive drum 23-1 and image transfer roller 21-1 becomes substantially equal to the distance L1 from medium feeder F of the main body of image formation apparatus 10 to the position of nip portion B (at the time when the leading end of print medium 100 arrives at the most downstream position P within the above-described zone that allows the toner-image transfer to be performed in time).

In this first embodiment, the delayed start of the rotations of belt motor 95 and drum motor 94 reduces the number of rotations of photosensitive drum 23 and conveyor belt 31 rotating wastefully in the above-described comparative example. Hence, the wear of photosensitive drum 23 and conveyor belt 31 caused by their rotations can be reduced. In addition, even if print medium 100 is fed from optional tray 11-3, the rotations of conveyor belt 31 and photosensitive drum 23 is started at the same timing as in the case where print medium 100 is fed from medium feeder F of the main body of image formation apparatus 10. Hence, the surface of photosensitive drum 23 can be electrically charged reliably. As a consequence, the degradation of image quality due to charging failure can be avoided.

After that, print medium 100 is conveyed by second resist-roller pair 18, and then passes through WR sensor 19. Then print medium 100 gets on top of conveyor belt 31 to be conveyed further by conveyor belt 31.

Print medium 100 turns ON WR sensor 19, and then is conveyed to conveyor belt 31 that is located downstream in the medium conveyance path. Then, print medium 100 is conveyed sequentially to the four image formation units 22 of black (K), yellow (Y), magenta (M), and cyan (C) arranged in this order Toner images of the four colors are transferred to print medium 100 by the image formation units 22, and then the toner images are fixed to the surface of print medium 100 by fixation unit 40.

After the toner images are fixed to the surface of print medium 100, the leading end of print medium 100 is detected by EXIT sensor 51, and print medium 100 is conveyed by the rotations of pairs of discharger rollers 52 to 54. Note that in this first embodiment, image processor circuit 61 as a medium-size detector detects the conveyance-direction dimension of print medium 100 on the basis of the print data sent from a host computer or an external apparatus. Hence, the rotations of conveyor belt 31 and photosensitive drum 23 can be stopped before the trailing end of print medium 100 completely passes through fixation roller 41 and then through EXIT sensor 51. Specifically, the number of drive pulses of belt motor 95 after the detection of the leading end of print medium 100 by EXIT sensor 51 is measured, and then whether or not the trailing end of print medium 100 has passed through the image transfer position of the most downstream image formation unit 22-4 is judged on the basis of the measured number of drive pulses. Then, belt motor 95 and drum motor 94 are stopped. The judgment relies on a threshold value of the number of drive pulses. The threshold value of the number of drive pulses is the number of drive pulses of a case where the print medium 100 is conveyed over a distance obtained by subtracting the first distance between the most downstream image formation unit 22-4 and EXIT sensor 51 from conveyance-direction dimension of print medium 100.

A predetermined time after that, fixation motor 96 is stopped. Print medium 100 thus conveyed is then discharged to stacker 55 or face-up stacker 56 through a discharge route selected by the user.

Figure 5:
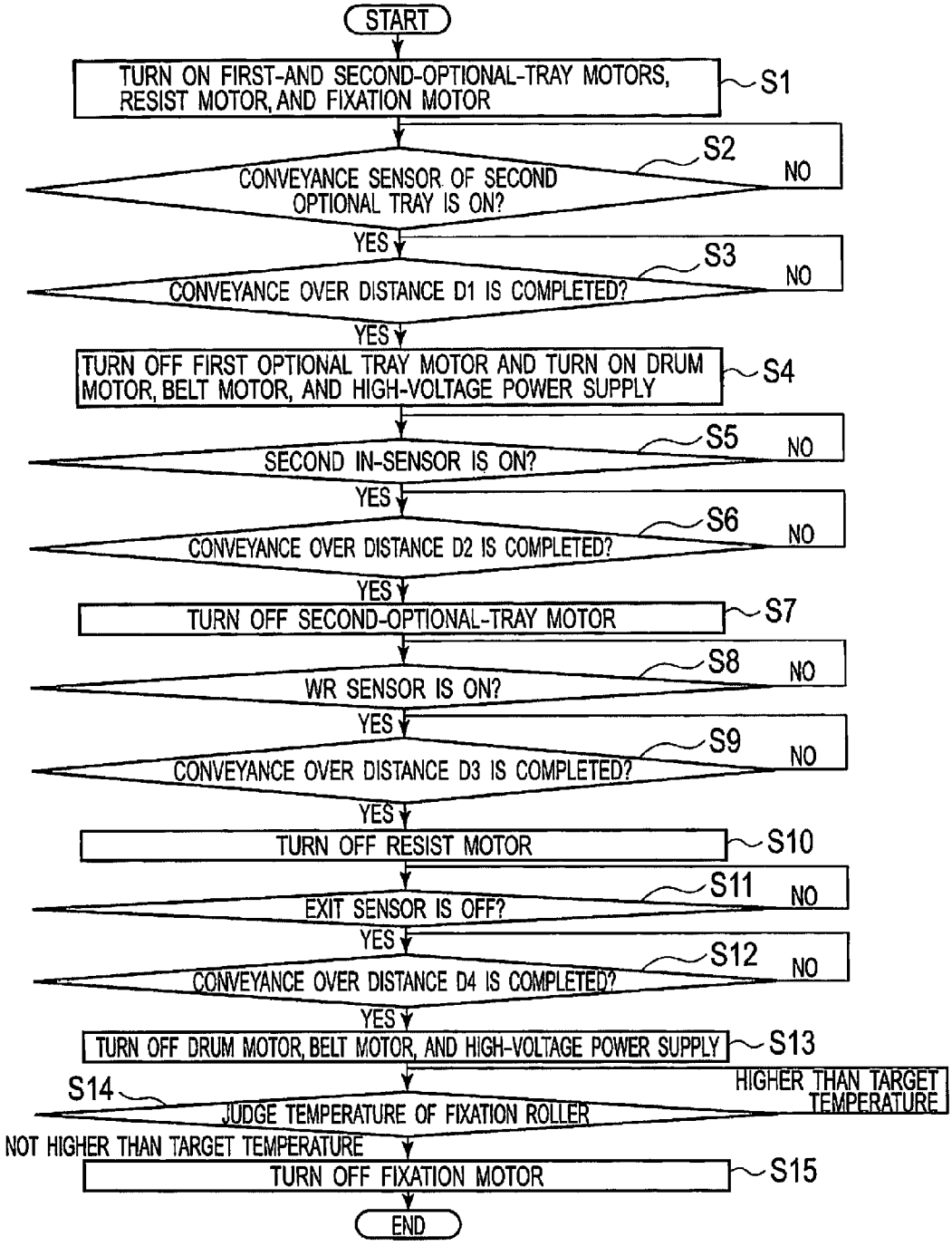
FIG. 5 is a flowchart illustrating the operations of the image formation apparatus according to the first embodiment of the invention.
Figure 6:
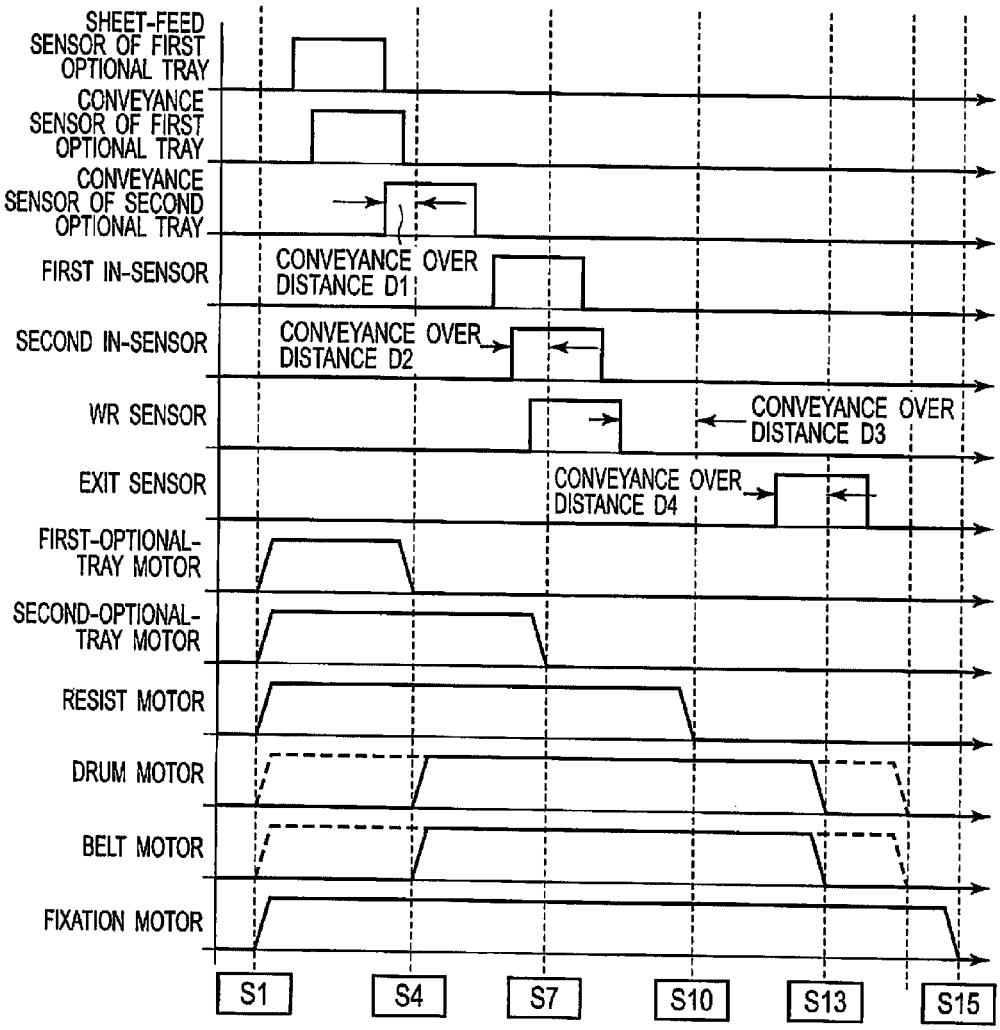
FIG. 6 is a time chart illustrating the operations of the image formation apparatus according to the first embodiment of the invention.

FIG. 5 is a flowchart illustrating the operations of image formation apparatus 10 according to the first embodiment of the invention. FIG. 6 is a time chart illustrating the operations of image formation apparatus 10 according to the first embodiment of the invention.

In the time chart of FIG. 6, the vertical axis represents an ON state at the upper position and an OFF state at the lower position. The horizontal axis represents the passage of time. The thick solid lines are of the control performed in the first embodiment while the thick dashed lines represent the control performed in the comparative example.

At the beginning of the process, at step S1, controller 60 of image formation apparatus 10 turns ON first-optional-tray motor 92-3, second-optional-tray motor 92-2, resist motor 93, fixation motor 96, and high-voltage power supply 63 not illustrated in the time chart but needed for the electrophotographic process.

At step S2, controller 60 of image formation apparatus 10 waits for the leading end of print medium 100 fed from first optional tray 11-3 to turn ON conveyance sensor 15-2 of second optional tray 11-2.

At step S3, controller 60 of image formation apparatus 10 instructs optional tray controller 80 to continue the conveyance of print medium 100 until it is judged that the conveyance of print medium 100 over distance D1 is completed. Distance D1 is obtained by adding a safety margin to the distance over which print medium 100 is conveyed since the leading end of print medium 100 turns ON conveyance sensor 15-2 of second optional tray 11-2 until the trailing end of print medium 100 passes through conveyance rollers 16-3 of first optional tray 11-3.

At step S4, controller 60 of image formation apparatus 10 instructs optional tray controller 80 to stop first-optional-tray motor 92-3. In addition, controller 60 starts driving belt motor 95 and drum motor 94, and turns ON high-voltage power supply 63. From then onwards, print medium 100 is conveyed without being driven by first-optional-tray motor 92-3 (pick-up roller 12-3 and sheet-feeder roller 13-3).

Upon detecting the turning ON of second IN-sensor 17 at step S5, controller 60 of image formation apparatus 10 waits for print medium 100 to be conveyed over distance D2 after turning ON second IN-sensor 17 at step S6. Distance D2 is obtained by adding a safety margin to the distance over which print medium 100 is conveyed after the leading end of print medium 100 turns ON second IN-sensor 17 until the trailing end of print medium 100 passes by conveyance rollers 16-2 of second optional tray 11-2.

If controller 60 judges that print medium 100 is conveyed over distance D2 after turning ON of second IN-sensor 17 (Yes at step S6), then at step S7 controller 60 of image formation apparatus 10 instructs optional tray controller 80 to turn OFF second-optional-tray motor 92-2 thereby stopping the rotation of conveyance rollers 16-2. Accordingly, from then onwards, print medium 100 is conveyed without being driven by second-optional-tray motor 92-2 (conveyance rollers 16-2).

Upon detecting the turning OFF of WR sensor 19 by the trailing end of print medium 100 at step S8, controller 60 of image formation apparatus 10 waits for print medium 100 to be conveyed over distance D3 at step S9. Distance D3 is the safety margin after the trailing end of print medium 100 passes by WR sensor 19.

If controller 60 of image formation apparatus 10 judges that print medium 100 is conveyed over distance D3 after turning OFF WR sensor 19 (Yes at step S9), at step S10, controller 60 turns OFF resist motor 93 to stop the rotations of first resist-roller pair 16-1 and second resist-roller pair 18. Hence, print medium 100 is conveyed toward the downstream by the conveyance force of photosensitive drum 23 and image transfer roller 21 and by the conveyance force of fixation unit 40.

Upon detecting the turning ON of EXIT sensor 51 by the leading end of print medium 100, at step S11, controller 60 of image formation apparatus 10 waits for print medium 100 to be conveyed over distance D4 at step S12. Distance D4 is obtained by adding a safety margin to the distance over which print medium 100 is conveyed after the leading end of print medium 100 passes through EXIT sensor 51 until the trailing end of print medium 100 passes through the most downstream image formation unit 22-4.

If controller 60 of image formation apparatus 10 judges that print medium 100 is conveyed over distance D4 after turning ON of EXIT sensor 51 (Yes at step S12), then at step S13, controller 60 stops drum motor 94 and belt motor 95 and turns OFF high-voltage power supply 63.

If, at step S14, controller 60 of image formation apparatus 10 judges that the discharge of print medium 100 by fixation motor 96 has been completed and that the temperature of fixation unit 40 is low enough to stop the rotation, then at step S15, controller 60 stops fixation motor 96, thereby terminates the print operations shown in FIG. 5.

Effects of First Embodiment

Image formation apparatus 10 of this first embodiment has the following effects (A) to (C).

(A) In the comparative example, even if image formation process is started while print medium 100 is within the zone that allows the transferring of the toner image to be performed in time (i.e., even if print medium 100 is at the upstream side of the most downstream position P of the above-mentioned zone for in-time toner-image transfer), photosensitive drum 23 and conveyor belt 31 rotate wastefully.

In contrast, in this first embodiment, the driving of drum motor 94 and belt motor 95 is started at the time when print medium 100 arrives at the most downstream position P of the zone that allows the toner-image transfer to be performed in time. Accordingly, photosensitive drum 23 and conveyor belt are prevented from rotating wastefully, and the service lives of these consumable members can be prolonged.

(B) In this first embodiment, belt motor 95 and drum motor 94 are stopped if it is judged that the trailing end of print medium 100 passes through the image transfer position of the most downstream image formation unit 22-4. Accordingly, photosensitive drum 23 and conveyor belt 31 are prevented from rotating wastefully, and the service lives of these consumable members can be prolonged.

(C) Controller 60 controls the driving of photosensitive drum 23 and image transfer roller 21 on the basis of the detection results of conveyance sensor 15-2 provided at a substantially linear section of the medium conveyance path which allows print medium 100 to be conveyed stably and located at the upstream side, in the medium-conveyance direction, of photosensitive drum 23-1 and downstream, in the medium-conveyance direction, of first optional tray 11-3. Accordingly, even if print medium 100 is fed from first optional tray 11-3 not smoothly, the driving of photosensitive drum 23 and image transfer roller 21 can be controlled stably.

Second Embodiment

Configuration of Second Embodiment

In a second embodiment of the invention, image formation apparatus 10 has an identical configuration to the one in the first embodiment shown in FIG. 1, but has different operations.

In the second embodiment, if it is judged that photosensitive drums 23 has a surface potential that is equal to or higher than a predetermined threshold, the charging step performed at the beginning of the above-described image formation process in the first embodiment is omitted. As a consequence, the start of the image formation process is delayed further.

Figure 7:
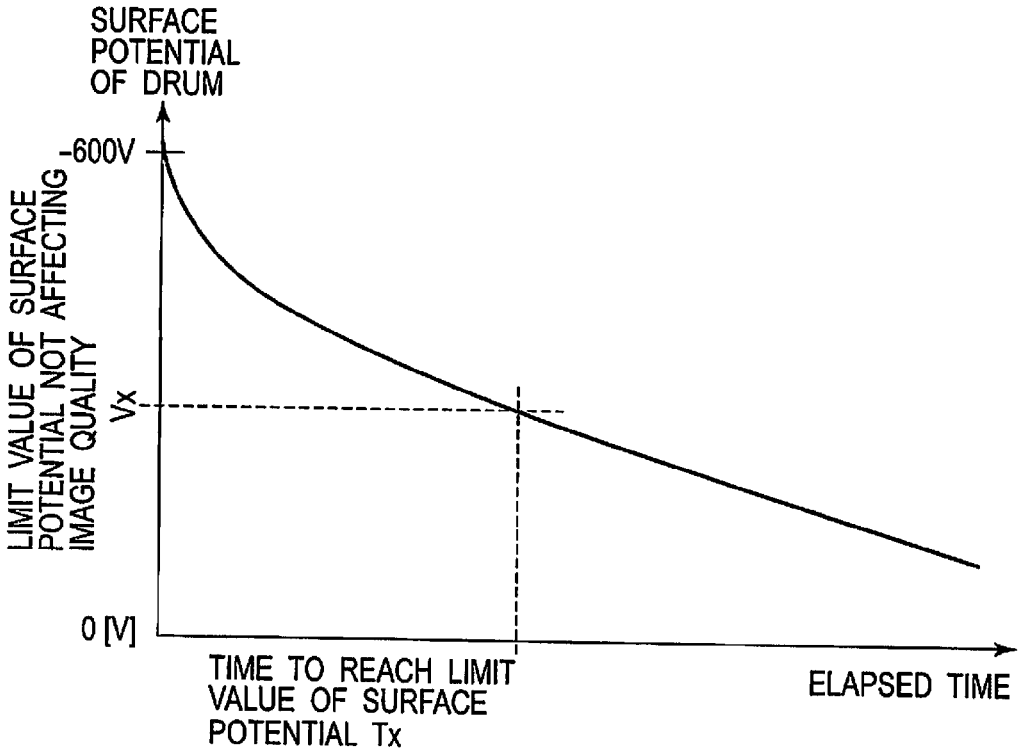
FIG. 7 is a chart illustrating the relationship between the surface potential of a photosensitive drum shown in FIG. 2 and the elapsed time.

FIG. 7 is a chart illustrating the relationship between the surface potential of photosensitive drum 23 shown in FIG. 2 and the elapsed time. The vertical axis represents the surface potential of photosensitive drum 23 whereas the horizontal axis represents the elapsed time.

The graph shown in FIG. 7 illustrates how the surface potential of photosensitive drum 23 attenuates as time elapses since the application of voltage to photosensitive drum 23 is stopped. Threshold voltage Vx is the limit value of the surface potential that does not adversely affect the image quality. Threshold time Tx is the elapsed time until the surface potential is lowered down to threshold voltage Vx.

The data on the attenuation characteristics of the surface potential of photosensitive drum 23 shown in FIG. 7 are stored in non-volatile memory 67. Note that photosensitive drum 23 of this second embodiment preferably has favorable surface-potential attenuation characteristics so that the surface potential of photosensitive drum 23 attenuate slowly.

Operations of Second Embodiment

Operations of this second embodiment are described by referring to FIG. 1.

As in the first embodiment, a feature of the second embodiment lies in the control method of a case where print medium 100 is conveyed over a long distance. So, the following description is given of the operations of a case where print medium 100 is fed from first optional tray 11-3. Note that the operations of the second embodiment is also applicable to a case where print medium 100 is fed from second optional tray 11-2. If print medium 100 fed from medium feeder F of the main body of image formation apparatus 10 has to be conveyed over a long distance, the operations of the second embodiment is also applicable to a case where print medium 100 is fed from medium feeder F.

Image formation apparatus 10 receives, from an unillustrated external apparatus, print data and an instruction to make the printing be performed using print media 100 stored in first optional tray 11-3. Then, image formation apparatus 10 makes first-optional-tray motor 92-3 rotate pick-up roller 12-3 and sheet-feeder roller 13-3. With the rotations of pick-up roller 12-3, each of print media 100 is separated from the others. Then, the print media 100 thus separated are sent, one by one, to the downstream side of the medium conveyance path.

As in the first embodiment, in this second embodiment, on the basis of the print data sent from the host computer or the external apparatus, image processor circuit 61 as a size detector detects the conveyance-direction dimension of print medium 100.

After print medium 100 passes through pick-up roller 12-3, sheet-feeder roller 13-3 further conveys print medium 100. Note that, as in the first embodiment, in this second embodiment, the driving of resist motor 93, fixation motor 96, and second-optional-tray motor 92-2 is started substantially at the same time as the driving of first-optional-tray motor 92-3 is started. Unlike the comparative example, the driving of neither belt motor 95 nor drum motor 94 is started at that timing. In this second embodiment, the rotations of neither belt motor 95 nor drum motor 94 are started substantially at the same time as the rotations of first-optional-tray motor 92-3 are started. This is because of a similar reason to the one in the first embodiment.

Note that, if the temperature of fixation roller 41 is at the target temperature, the driving of fixation motor 96 is started substantially at the same time as the feeding of print medium 100 is started as described earlier. If, conversely, the temperature of fixation roller 41 is lower than the target temperature, the driving of fixation motor 96 is started before the feeding of print medium 100 is started to warm up fixation roller 41.

When sheet-feed sensor 14-3 detects that print medium 100 is fed properly, butting control to correct skew of print medium 100 is performed by using conveyance sensor 15-3 and conveyance rollers 16-3. Print medium 100 passes through conveyance sensor 15-2, conveyance rollers 16-2, first IN-sensor 15-1, first resist-roller pair 16-1, and second IN-sensor 17. Then, print medium 100 is conveyed to second resist-roller pair 18.

As in the first embodiment, in this second embodiment, when conveyance sensor 15-2 detects the leading end of print medium 100, controller 60 makes optional tray controller 80 of second optional tray 11-2 count the number of drive pulses outputted from the detection position through I/O port 85 to driver circuits 86-2 of second-optional-tray motor 92-2. On the basis of this counting, controller 60 of this second embodiment judges whether or not the distance from the leading end of print medium 100 to the position of nip portion B (image transfer position) between photosensitive drum 23-1 and image transfer roller 21-1 is equal to distance L1 from medium feeder F to the position of nip portion B. If controller 60 judges that the above-mentioned two distances are substantially equal to each other, controller 60 then judges whether or not the charging-process suspension period measured by timer 78 as a charge-voltage judgment portion exceeds threshold time Tx shown in FIG. 7. Note that the charging-process suspension period is the time elapsed since the application of voltage to photosensitive drum 23 is stopped.

If controller 60 judges that the charging-process suspension period exceeds the threshold time Tx (i.e., that the image quality deteriorates when no extra charging process is performed), the driving of drum motor 94 and belt motor 95 is started, and high-voltage power supply 63 is turned ON, as in the case of the first embodiment.

If, in contrast, controller 60 judges that the charging-process suspension period does not exceed the threshold time Tx, that is, that the surface potential of photosensitive drum is high enough to allow image formation process to be performed without an extra charging process, controller 60 turns OFF only first-optional-tray motor 92-3. Then, if controller 60 judges that print medium 100 has been conveyed over distance D5 after the detection of the turning ON of WR sensor 19, controller 60 starts driving drum motor 94 and belt motor 95 and turns ON high-voltage power supply 63. Distance D5 is the distance from the position where the leading end of print medium 100 reaches WR sensor 19 to a predetermined position that guarantees the in-time arrival of print medium 100 for image formation process. Note that, unlike the image formation process of the first embodiment, the image formation process of this second embodiment is not commenced by the start of the charging process but by the start of latent-image formation process to form an electrostatic latent image on the surface of photosensitive drum 23 as an image carrier.

In this second embodiment, controller 60 measures the length of time the charging process to electrically charge the surface of each photosensitive drum 23 is suspended. If the result of measurement does not reach threshold time Tx, controller 60 judges that the image quality is not adversely affected even when no extra charging process is performed. Hence, controller 60 begins the image formation process with the start of rotation of photosensitive drum 23 to start light exposure and with the start of the rotations of the conveyor belt 31 without performing any preceding charging process. The start of the driving of belt motor 95 and drum motor 94 at this time delays the start of rotations of photosensitive drums 32 and conveyor belt 31 in comparison to the cases of the control in the comparative example or of the control in the first embodiment. Accordingly, the numbers of rotations of photosensitive drum 23 and conveyor belt 31 are reduced from their respective counterparts in the case of the control of the comparative example or in the case of the control of the first embodiment. Consequently, the wear of these members can be reduced more effectively.

After that, print medium 100 is conveyed to second resist-roller pair 18, and then passes through WR sensor 19. Then print medium 100 gets on top of conveyor belt 31 to be conveyed further by conveyor belt 31.

Print medium 100 turns ON WR sensor 19, and then is conveyed to conveyor belt 31 that is located downstream in the medium conveyance path. Then, print medium 100 is conveyed sequentially to the four image formation units 22 of black (K), yellow (Y), magenta (M), and cyan, arranged in this order. Toner images of the four colors are transferred to print medium 100 by the image formation units 22, and then the toner images are fixed to the surface of print medium 100 by fixation unit 40.

After the toner images are fixed to the surface of print medium 100, the leading end of print medium 100 is detected by EXIT sensor 51, and then print medium 100 is conveyed by the rotations of pairs of discharger rollers 52 to 54. Note that, as in the first embodiment, in this second embodiment, image processor circuit 61 as a medium-size detector detects the conveyance-direction dimension of print medium 100 on the basis of the print data sent from a host computer or an external apparatus. Hence, the rotations of conveyor belt 31 and photosensitive drum 23 can be stopped before the trailing end of print medium 100 completely passes through fixation roller 41 and then through EXIT sensor 51. Specifically, the number of drive pulses of belt motor 95 after the detection of the leading end of print medium 100 by EXIT sensor 51 is measured, and then if it judged that the trailing end of print medium 100 has passed through the image transfer position of the most downstream image formation unit 22-4 on the basis of the measured number of drive pulses, belt motor 95 and drum motor 94 are stopped. A predetermined time after that, fixation motor 96 is stopped.

Print medium 100 thus conveyed is then discharged to stacker 55 or face-up stacker 56 through a discharge route selected by the user.

Figure 8:
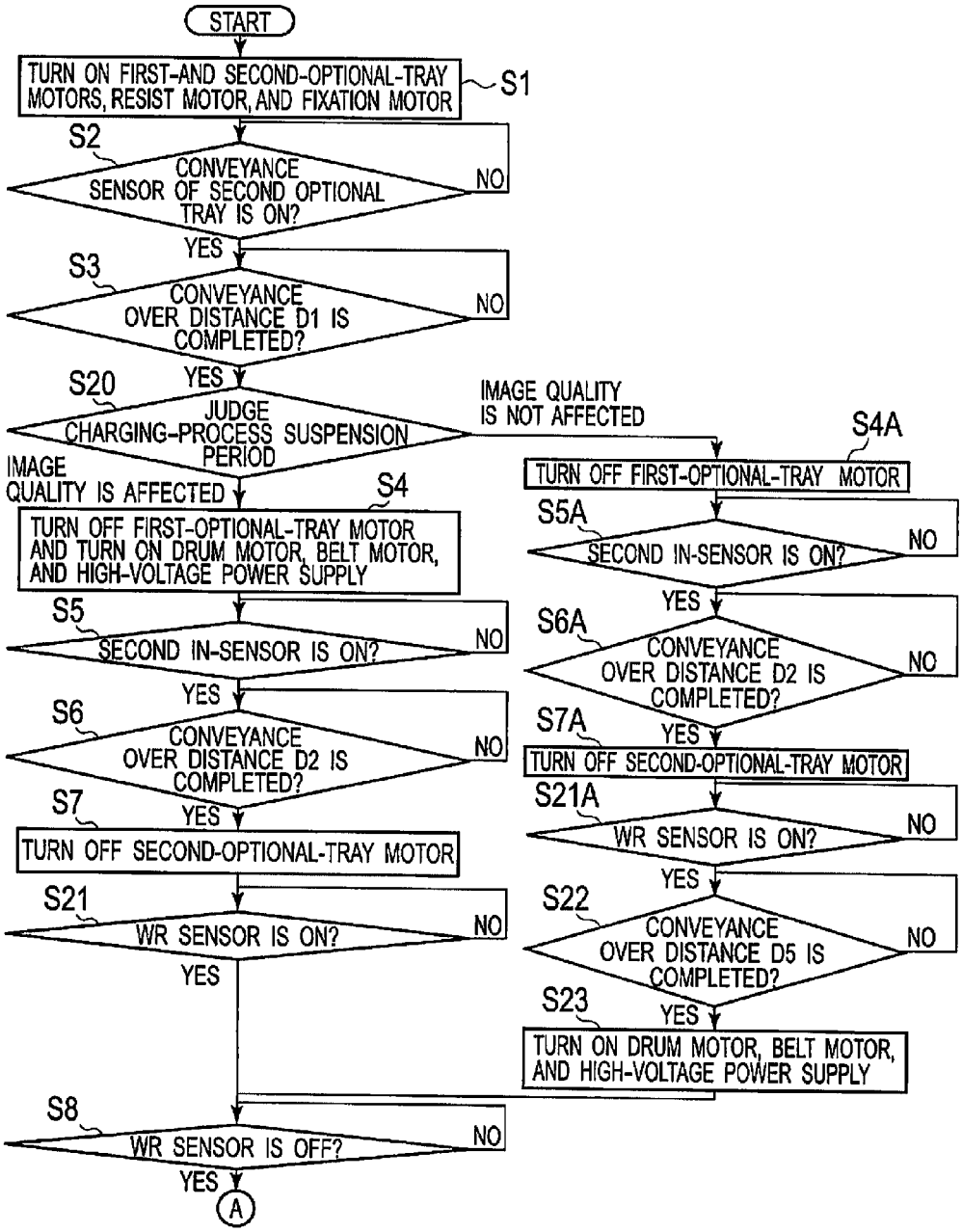
FIG. 8 is a flowchart (Part 1) illustrating the operations of an image formation apparatus according to a second embodiment of the invention.
Figure 9:
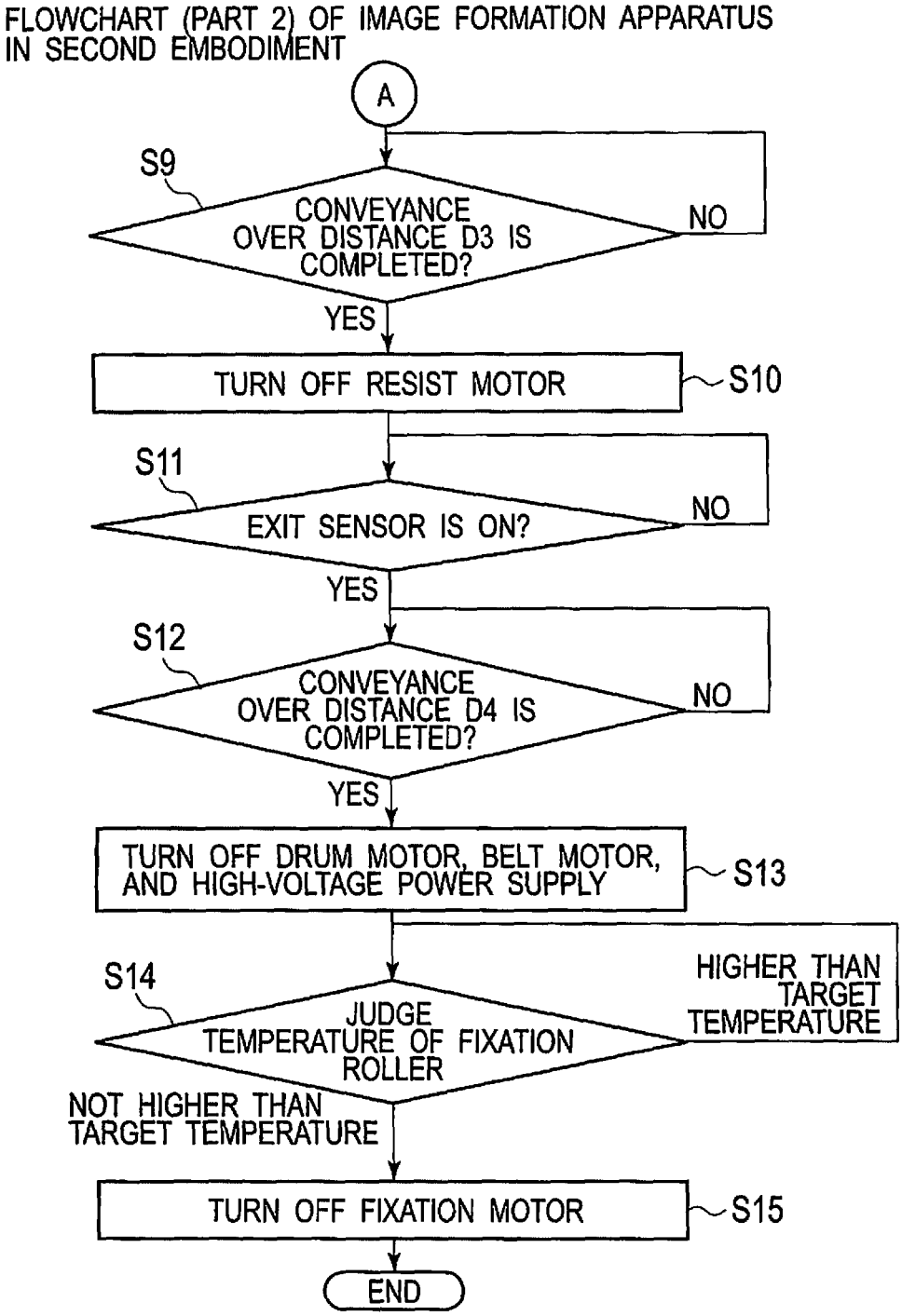
FIG. 9 is a flowchart (Part 2) illustrating the operations of an image formation apparatus according to the second embodiment of the invention.

FIGS. 8 and 9 are flowcharts (Part 1 and Part 2) illustrating the operations of the image formation apparatus according to the second embodiment of the invention. Elements therein that are the same as the ones that appear in FIG. 5 showing the first embodiment are denoted by their respective reference numerals.

Figure 10:
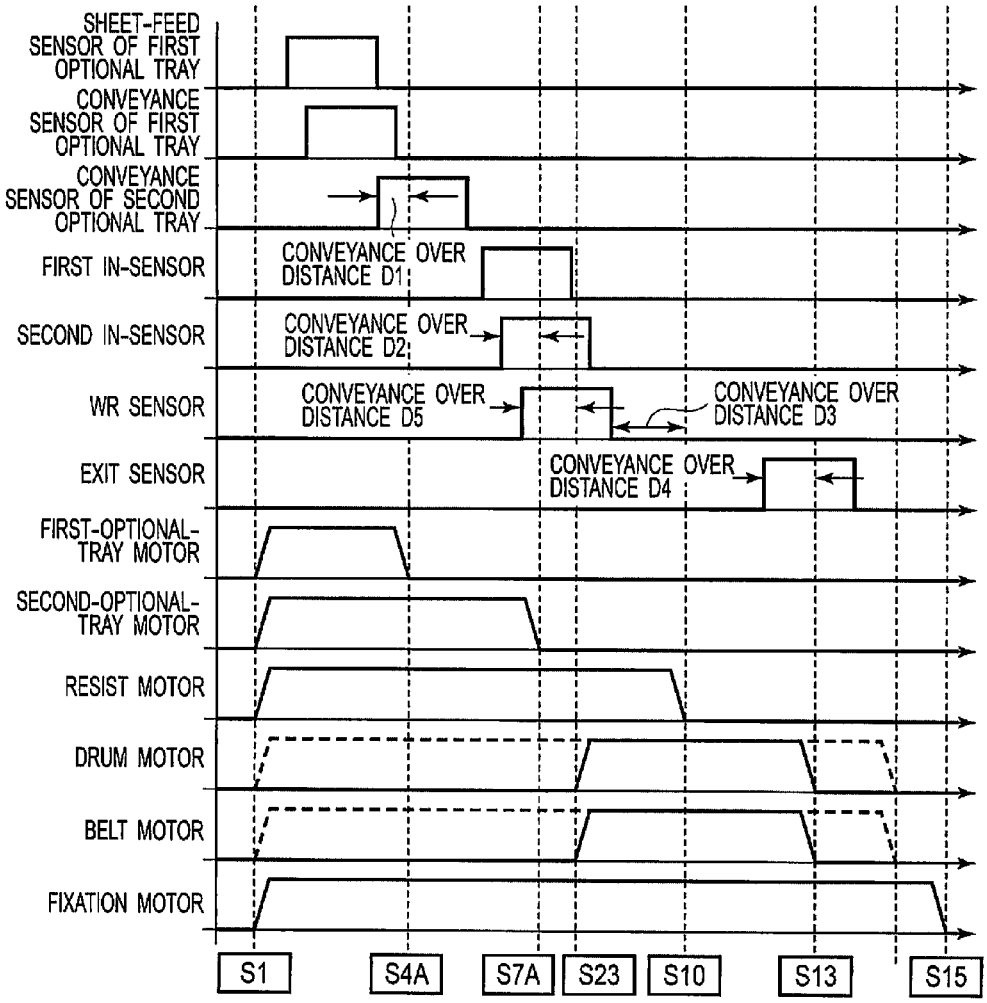
FIG. 10 is a time chart illustrating the operations of the image formation apparatus according to the second embodiment of the invention.

FIG. 10 is a time chart illustrating the operations of the image formation apparatus of the second embodiment of the invention of a case where the charging-process suspension period does not exceed threshold time Tx. Elements in FIG. 10 same as the ones those in FIG. 6 showing the first embodiment are denoted by their respective reference numerals. In the time chart of FIG. 10, the vertical axis represents an ON state at the upper position and an OFF state at the lower position. The horizontal axis represents the passage of time. The thick solid lines are of the control performed in the second embodiment while the thick dashed lines represent the control performed in the comparative example.

At the beginning of the processes, the processes performed at steps S1 to S3 are the same as those the first embodiment. At step S20, controller 60 of image formation apparatus 10 judges whether or not the charging-process suspension period measured by timer 78 exceeds threshold time Tx shown in FIG. 7.

If charging-process suspension period does not exceed threshold time Tx, first-optional-tray motor 92-3 is turned OFF, and the rotations of pick-up roller 12-3 and sheet-feeder roller 13-3 are stopped at step S4A. From then onwards, print medium 100 is conveyed without being driven by first-optional-tray motor 92-3 (pick-up roller 12-3 and sheet-feeder roller 13-3). The processes at steps S5A to S7A are similar to the processes at steps S5 to S7 in the first embodiment. If, at step S21A, the turning ON of WR sensor 19 is detected, controller 60 of image formation apparatus 10 waits for print medium 100 to be conveyed over distance D5 at step S22. Distance D5 is the distance from the position where the leading end of print medium 100 reaches WR sensor 19 to a predetermined position that guarantees the in-time arrival of print medium 100 for image formation process. If, at step S22, controller 60 of image formation apparatus 10 judges that print medium 100 has been conveyed over distance D5 after turning ON of WR sensor 19, then at step S23, controller 60 starts driving drum motor 94 and belt motor 95 and turns ON high-voltage power supply 63.

If, in contrast, at step S20, the charging-process suspension period exceeds threshold time Tx, the processes at step S4 to S7 are performed, and then at step S21 controller 60 waits for the turning ON of WR sensor 19 to be detected. Then at step S8, the process that is similar to that at step S8 in the first embodiment is performed. After that, the processes of node A shown in FIG. 9 are performed.

Once the processes of node A shown in FIG. 9 are started, the processes of step S9 to S15 are performed as in the first embodiment. Then, the print process shown in FIG. 9 is terminated.

Effects of Second Embodiment

Image formation apparatus 10 of this second embodiment can delay further the start of the driving of photosensitive drum 23 and conveyor belt 31. Hence, the period in which the driving of photosensitive drum 23 and conveyor belt 31 can be suspended can be prolonged. Accordingly, the idle driving of photosensitive drum 23 and conveyor belt 31 can be reduced even from the case of the first embodiment. As a consequence, the service lives of these members can be prolonged even further.

Third Embodiment

Configuration of Third Embodiment

The configuration of image formation apparatus 10 of a third embodiment of the invention is identical to the configuration of image formation apparatus 10 of the first embodiment shown in FIG. 1.

Operations of Third Embodiment

A feature of the third embodiment lies in the control method of a case where print medium 100 is conveyed over a long distance. So, the following description is given of the operations of a case where print medium 100 is fed from first optional tray 11-3. If the conveyed distance is long, the operations of the third embodiment is also applicable to a case where print medium 100 is fed from second optional tray 11-2 and to a case where print medium 100 is fed from medium feeder F.

Image formation apparatus 10 receives, from an unillustrated external apparatus, print data and an instruction to make the printing be performed using print media 100 stored in first optional tray 11-3. Then, image formation apparatus 10 makes first-optional-tray motor 92-3 rotate pick-up roller 12-3 and sheet-feeder roller 13-3. With the rotations of pick-up roller 12-3, each of print media 100 is separated from the others. Then, the print media 100 thus separated are sent, one by one, to the downstream side of the medium conveyance path.

As in the first and the second embodiments, in this third embodiment, on the basis of the print data sent from the host computer or the external apparatus, image processor circuit 61 as the size detector detects the conveyance-direction dimension of print medium 100.

After print medium 100 passes through pick-up roller 12-3, sheet-feeder roller 13-3 further conveys print medium 100. In this third embodiment, the driving of resist motor 93, fixation motor 96, second-optional-tray motor 92-2, belt motor 95, and drum motor 94 is started, and high-voltage power supply 63 is turned ON substantially at the same time as the driving of the first-optional-tray motor 92-3 is started. In this case, the drive speed (first speed) of belt motor 95 and drum motor 94 are slower at the beginning of the drive than the drive speed (second speed) of these motors 95 and 94 at the time of the toner-image transfer. The drive speed of these motors 95 and 94 is switched from the first speed to the second speed at a time when the leading end of print medium 100 reaches point P in the medium conveyance path. Accordingly, in comparison to a case where photosensitive drum 23 and conveyor belt 31 always rotate at the normal rotational speeds (moving speeds), the wear of photosensitive drum 23 and conveyor belt 31 can be reduced, and the service lives of photosensitive drum 23 and conveyor belt 31 can be prolonged.

Note that if the temperature of fixation roller 41 is at the target temperature, the driving of fixation motor 96 is started substantially at the same time as the feeding of print medium 100 is started as described earlier. If, in contrast, the temperature of fixation roller 41 is lower than the target temperature, the driving of fixation motor 96 precedes the start of the feeding of print medium 10 to warm up fixation roller 41.

When sheet-feed sensor 14-3 detects that print medium 100 is fed properly, butting control to correct skew of print medium 100 is performed using conveyance sensor 15-3 and conveyance rollers 16-3. Print medium 100 passes by conveyance sensor 15-2, conveyance rollers 16-2, first IN-sensor 15-1, first resist-roller pair 16-1, and second IN-sensor 17, and then is conveyed to second resist-roller pair 18.

As in the first and the second embodiments, if, in this third embodiment, the conveyance sensor 15-2 detects the leading end of print medium 100, the counting of the number of drive pulses of driver circuit 86-2 of second-optional-tray motor 92-2 is started by using optional tray controller 80 of second optional tray 11-2. Specifically, the counting starts at the time when the print medium 100 is at this detection position. On the basis of this counting, the drive speed of the drum motor 94 and that of belt motor 95 is switched to the drive speed (the second speed) at the time of toner-image transfer. Specifically, the switching of the speeds is done at a time when it is judged that the conveyance distance of the print medium 100 measured from the position of the leading end of print medium 100 to the position of nip portion B (image transfer position) becomes substantially equal to the conveyance distance (L1) measured from medium feeder F of main body of image formation apparatus 10 to the position of nip portion B. To put it differently, the speed is switched at the time when it is judged that the leading end of print medium 100 reaches point P.

In this third embodiment, the drive speed of belt motor 95 and drum motor 94 is switched from the slow first speed to the normal second speed at the above-described timing. Accordingly, the number of rotations of photosensitive drum 23 and that of conveyor belt 31 before switching of the speed can be reduced. Consequently, the wear of photosensitive drum 23 and conveyor belt 31 can be reduced. In addition, in this third embodiment, the rotational speed of belt motor 95 and drum motor 94 is slowed down before this timing, but the surface of photosensitive drum 23 is electrically charged reliably by high-voltage power supply 63. Consequently, the deterioration of image quality due to charging failure can be avoided.

Print medium 100 is then conveyed by second resist-roller pair 18 to passes through WR sensor 19, and then gets on top of conveyor belt 31 to be conveyed by conveyor belt 31.

To be more specific, print medium 100 turns ON WR sensor 19, and then is conveyed by conveyor belt 31 located downstream in the medium conveyance path sequentially to the four image formation units 22 of black (K), yellow (Y), magenta (M), and cyan (C) arranged in the order of black.

Toner images of the four colors are transferred to the surface of print medium 100 by image formation units 22, and then the toner images are fixed to the surface of print medium 100 by fixation unit 40.

After the toner images are fixed to the surface of print medium 100, the leading end of print medium 100 is detected by EXIT sensor 51, and then print medium 100 is conveyed by the rotations of pairs of discharger rollers 52 to 54. Note that, as in the first and the second embodiments, in this third embodiment, image processor circuit 61 as the medium-size detector detects the conveyance-direction dimension of print medium 100 on the basis of the print data sent from a host computer or an external apparatus. Hence, the rotations of conveyor belt 31 and photosensitive drum 23 can be stopped before the trailing end of print medium 100 completely passes through fixation roller 41 and then through EXIT sensor 51. Specifically, the number of drive pulses of belt motor 95 after the detection of the leading end of print medium 100 by EXIT sensor 51 is measured, and then if it is judged that the trailing end of print medium 100 has passed through the image transfer position of the most downstream image formation unit 22-4 on the basis of the measured number of drive pulses, controller 60 stops belt motor 95 and drum motor 94. A predetermined time after that, controller 60 stops fixation motor 96.

Print medium 100 thus conveyed is then discharged to stacker 55 or face-up stacker 56 through a discharge route selected by the user.

Figure 11:
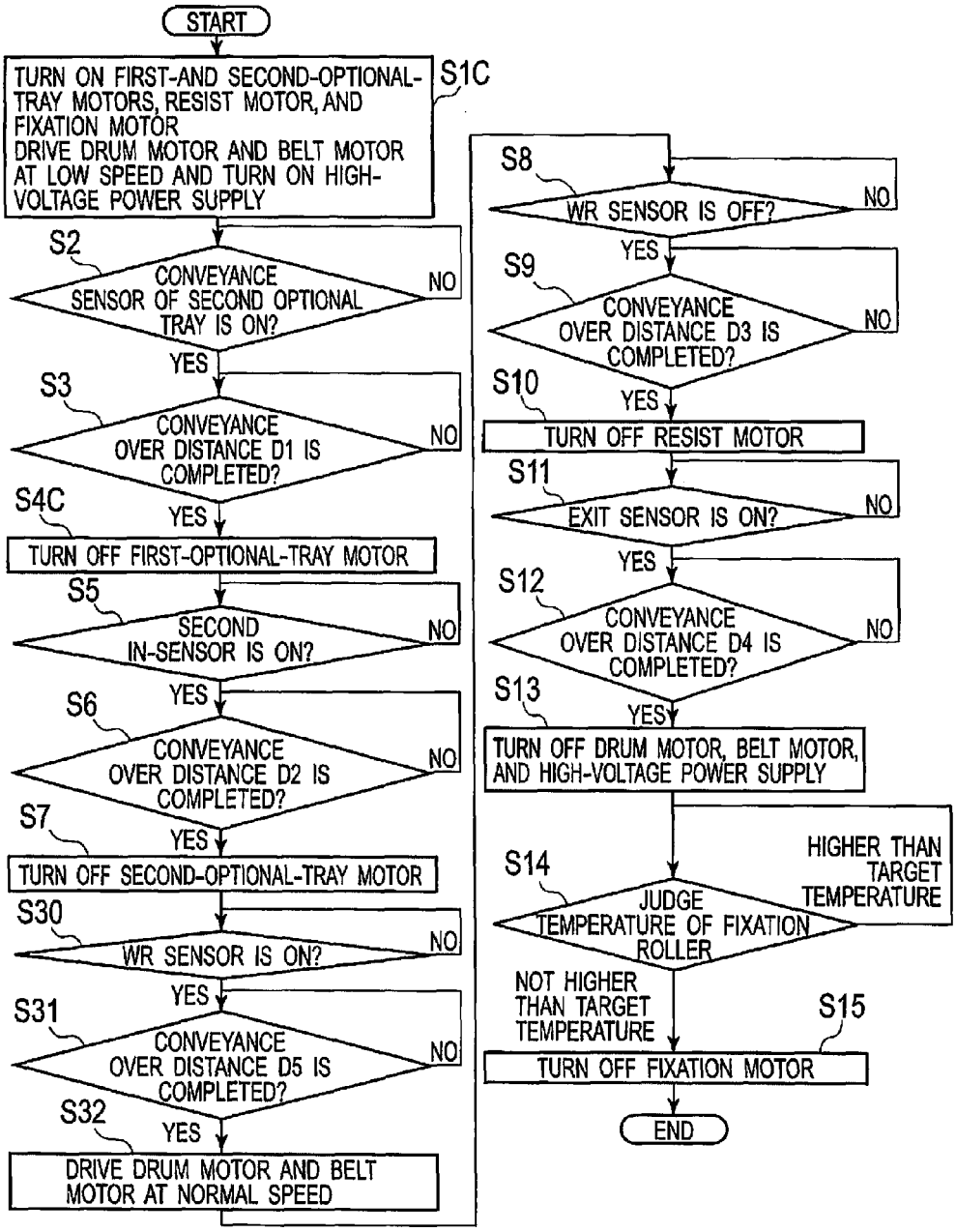
FIG. 11 is a flowchart illustrating the operations of the image formation apparatus according to a third embodiment of the invention.

FIG. 11 is a flowchart illustrating the operations of the image formation apparatus according to the third embodiment of the invention. Elements therein that are the same as the ones that appear in FIG. 5 showing the first embodiment are denoted by their respective reference numerals.

Figure 12:
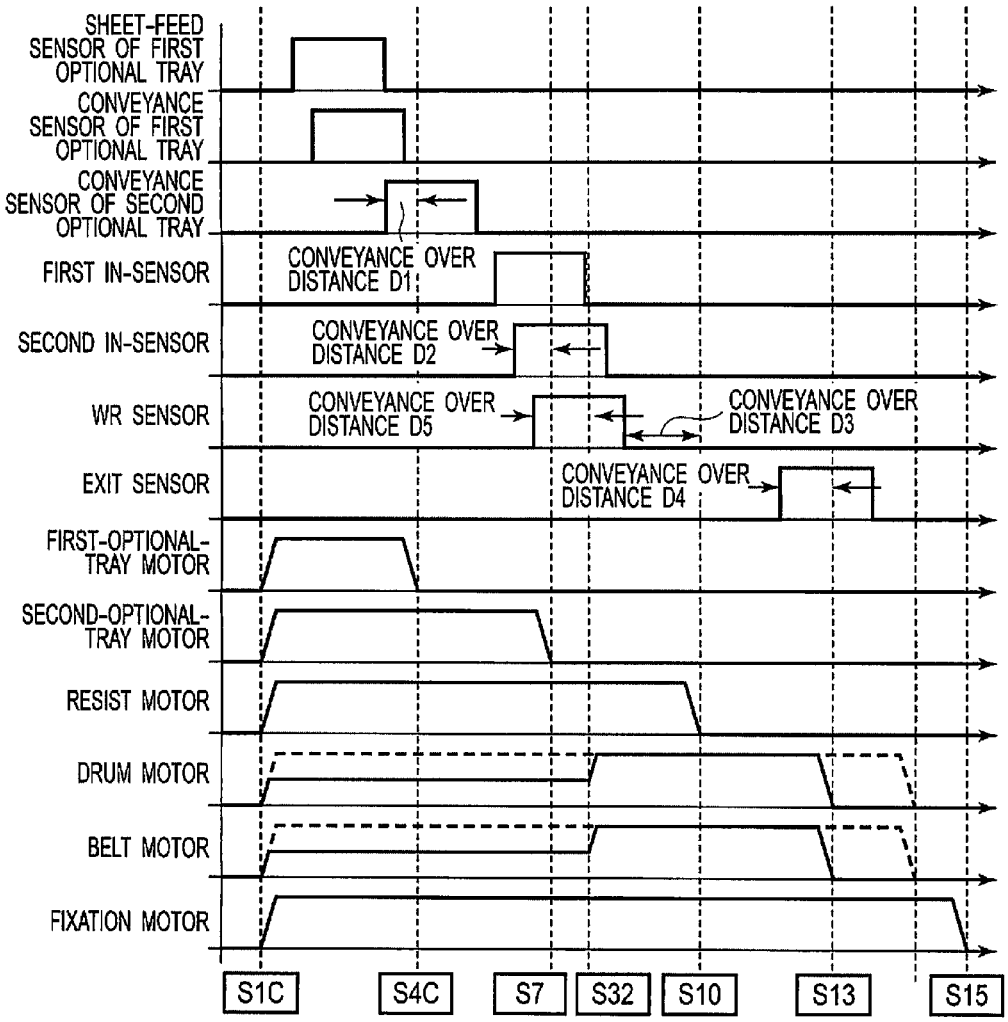
FIG. 12 is a time chart illustrating the operations of the image formation apparatus according to the third embodiment of the invention.

FIG. 12 is a time chart illustrating the operations of the image formation apparatus of the third embodiment of the invention of a case where the charging-process suspension period does not exceed threshold time Tx. Elements in FIG. 12 same as the ones those in FIG. 6 showing the first embodiment are denoted by their respective reference numerals. In the time chart of FIG. 12, the vertical axis represents an ON state at the upper position and an OFF state at the lower position. The horizontal axis represents the passage of time. The thick solid lines are of the control performed in the third embodiment while the thick dashed lines represent the control performed in the comparative example.

At the beginning of the process, controller 60 of image formation apparatus 10 turns ON first-optional-tray motor 92-3, second-optional-tray motor 92-2, resist motor 93, fixation motor 96, and high-voltage power supply 63 not illustrated in the time chart at step SIC. In addition, controller 60 drives drum motor 94 and belt motor 95 at the slow speed mode. The processes at steps S2 and S3 are the same as those in the first embodiment.

At step S4C, controller 60 of image formation apparatus instructs optional tray controller 80 to stop first-optional-tray motor 92-3 and thereby to stop the rotations of pick-up roller 12-3 and sheet-feeder roller 13-3. From then onwards, print medium 100 is conveyed without being driven by first-optional-tray motor 92-3 (pick-up roller 12-3 and sheet-feeder roller 13-3). The processes at steps S5 to S7 are the same as those in the first embodiment.

At step S30, controller 60 waits for the turning ON of WR sensor 19 by the leading end of print medium 100 to be detected. Then at step S31, controller 60 waits for print medium 100 to be conveyed over distance D5. Then at step S32, controller 60 speeds up the drive speed of drum motor 94 and belt motor 95 to the printing speed. The processes at steps S8 to S15 are the same as those in the first embodiment.

Effects of Third Embodiments

Image formation apparatus 10 of this third embodiment slows down the drive speed of photosensitive drum 23 and conveyor belt 31 and thereby can prolong the service lives of these members, even if image formation apparatus 10 of this third embodiment is not equipped with special photosensitive drum 23 like the one in the second embodiment whose surface potential is less likely to be attenuated. In addition, image formation apparatus of this third embodiment can electrically charge the surface of each photosensitive drum 23 so sufficiently that the transfer can provide fine image quality.

Fourth Embodiment

Configuration of Fourth Embodiment

The configuration of image formation apparatus 10 of a fourth embodiment of the invention is identical to the configuration of image formation apparatus 10 of the first embodiment shown in FIG. 1.

Operations of Fourth Embodiment

A feature of the fourth embodiment lies in the control method of a case where print medium 100 is conveyed over a long distance. So, the following description is given of the operations of a case where print medium 100 is fed from first optional tray 11-3. If the conveyed distance is long, the operations of the fourth embodiment is also applicable to a case where print medium 100 is fed from second optional tray 11-2 and to a case where print medium 100 is fed from medium feeder F of the main body of image formation apparatus 10.

Image formation apparatus 10 receives, from an unillustrated external apparatus, print data and an instruction to make the printing be performed using print media 100 stored in first optional tray 11-3. Then, image formation apparatus 10 makes first-optional-tray motor 92-3 rotate pick-up roller 12-3 and sheet-feeder roller 13-3. With the rotations of pick-up roller 12-3, each of print media 100 is separated from the others. Then, the print media 100 thus separated are sent, one by one, to the downstream side of the medium conveyance path.

As in the first to the third embodiments, in this fourth embodiment, on the basis of the print data sent from the host computer or the external apparatus, image processor circuit 61 as a size detector detects the conveyance-direction dimension of print medium 100.

Print medium 100 conveyed from pick-up roller 12-3 is further conveyed by the rotation of sheet-feeder roller 13-3. Note that in this fourth embodiment, the driving of resist motor 93, fixation motor 96, and second-optional-tray motor 92-2 is started substantially at the same time as the driving of first-optional-tray motor 92-3 is started. Unlike the comparative example, the driving of neither belt motor 95 nor drum motor 94 is started at that timing.

Note that, if the temperature of fixation roller 41 is at the target temperature, the driving of fixation motor 96 is started substantially at the same time as the feeding of print medium 100 is started as described earlier. If, conversely, the temperature of fixation roller 41 is lower than the target temperature, the driving of fixation motor 96 is started before the feeding of print medium 100 is started to warm up fixation roller 41.

When sheet-feed sensor 14-3 detects that print medium 100 is fed properly, butting control to correct skew of print medium 100 is performed by using conveyance sensor 15-3 and conveyance rollers 16-3. Print medium 100 passes through conveyance sensor 15-2, conveyance rollers 16-2, first IN-sensor 15-1, first resist-roller pair 16-1, and second IN-sensor 17. Then, print medium 100 is conveyed to second resist-roller pair 18.

In this fourth embodiment, if time T1 elapses after controller 60 starts the feeding of print medium 100 from first optional tray 11-3, an interrupt processing by timer 78 is performed. The interrupt processing is performed at a time when the conveyance distance of the print medium 100 measured from the position of the leading end of print medium 100 to the position of nip portion B becomes substantially equal to the conveyance distance measured from medium feeder F of main body of image formation apparatus 10 to the position of nip portion B. The position of the leading end of print medium 100 varies depending upon the structure of the apparatus and other factors. The timing of the interrupt processing may be delayed as long as the start of the rotations of photosensitive drum 23 and conveyor belt 31 allows the in-time arrival of print medium 100 for the transfer of toner images. The start of the rotations of belt motor 95 and drum motor 94 at this timing can reduce the rotations of photosensitive drum and conveyor belt 31 which rotate wastefully under the control in the comparative example. Consequently, the wear of these members due to the idle rotations can be avoided. In addition, even if print medium 100 is fed from optional tray 11-3, the rotations of conveyor belt 31 and photosensitive drum 23 is started at the same timing as in the case where print medium 100 is fed from medium feeder F of the main body of image formation apparatus 10. Hence, the surface of photosensitive drum 23 can be electrically charged reliably. As a consequence, the degradation of image quality due to charging failure can be avoided.

After that, print medium 100 is conveyed to second resist-roller pair 18, and then passes through WR sensor 19. Then print medium 100 gets on top of conveyor belt 31 to be conveyed further by conveyor belt 31.

Print medium 100 turns ON WR sensor 19, and then is conveyed to conveyor belt 31 that is located downstream in the medium conveyance path. Then, print medium 100 is conveyed sequentially to the four image formation units 22 of black (K), yellow (Y), magenta (M), and cyan (C), arranged in this order Toner images of the four colors are transferred on print medium 100 by the image formation units 22, and then the toner images are fixed to the surface of print medium 100 by fixation unit 40.

After the toner images are fixed to the surface of print medium 100, the leading end of print medium 100 is detected by EXIT sensor 51, and print medium 100 is conveyed by the rotations of pairs of discharger rollers 52 to 54. Note that, as in the first to the third embodiments, in this fourth embodiment, image processor circuit 61 as a medium-size detector detects the conveyance-direction dimension of print medium 100 on the basis of the print data sent from a host computer or an external apparatus. Hence, the rotations of conveyor belt 31 and photosensitive drum 23 can be stopped before the trailing end of print medium 100 completely passes through fixation roller 41 and then through EXIT sensor 51. Specifically, the number of drive pulses of belt motor 95 after the detection of the leading end of print medium 100 by EXIT sensor 51 is measured, and then if it is judged that the trailing end of print medium 100 has passed through the image transfer position of the most downstream image formation unit 22-4 on the basis of the measured number of drive pulses, controller 60 stops belt motor 95 and drum motor 94. A predetermined time after that, controller stops fixation motor 96.

Print medium 100 thus conveyed is then discharged to stacker 55 or face-up stacker 56 through a discharge route selected by the user.

Figure 13:
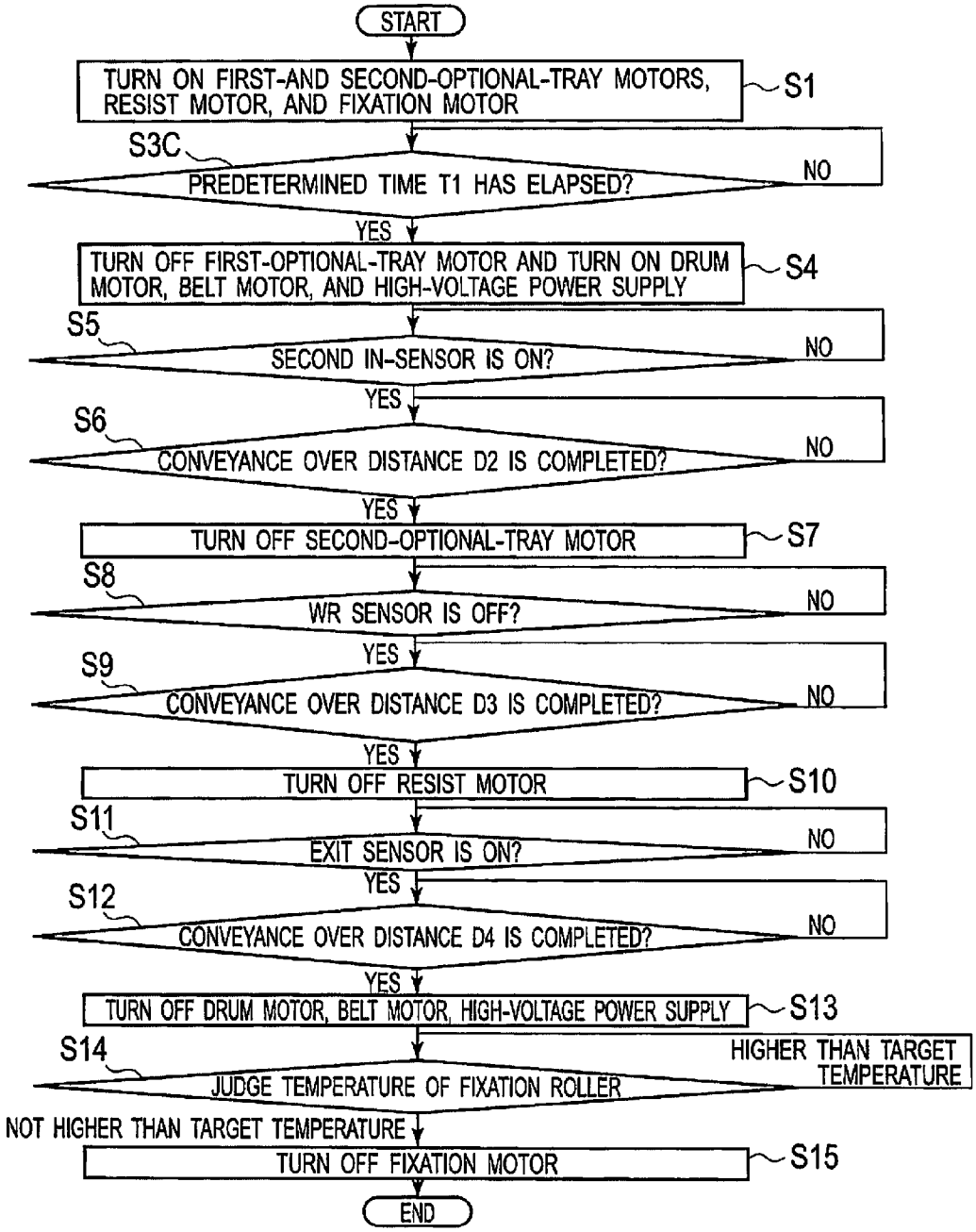
FIG. 13 is a flowchart illustrating the operations of the image formation apparatus according to a fourth embodiment of the invention.

FIG. 13 is a flowchart illustrating the operations of image formation apparatus 10 according to the fourth embodiment of the invention. Elements therein that are the same as the ones that appear in FIG. 5 showing the first embodiment are denoted by their respective reference numerals.

Figure 14:
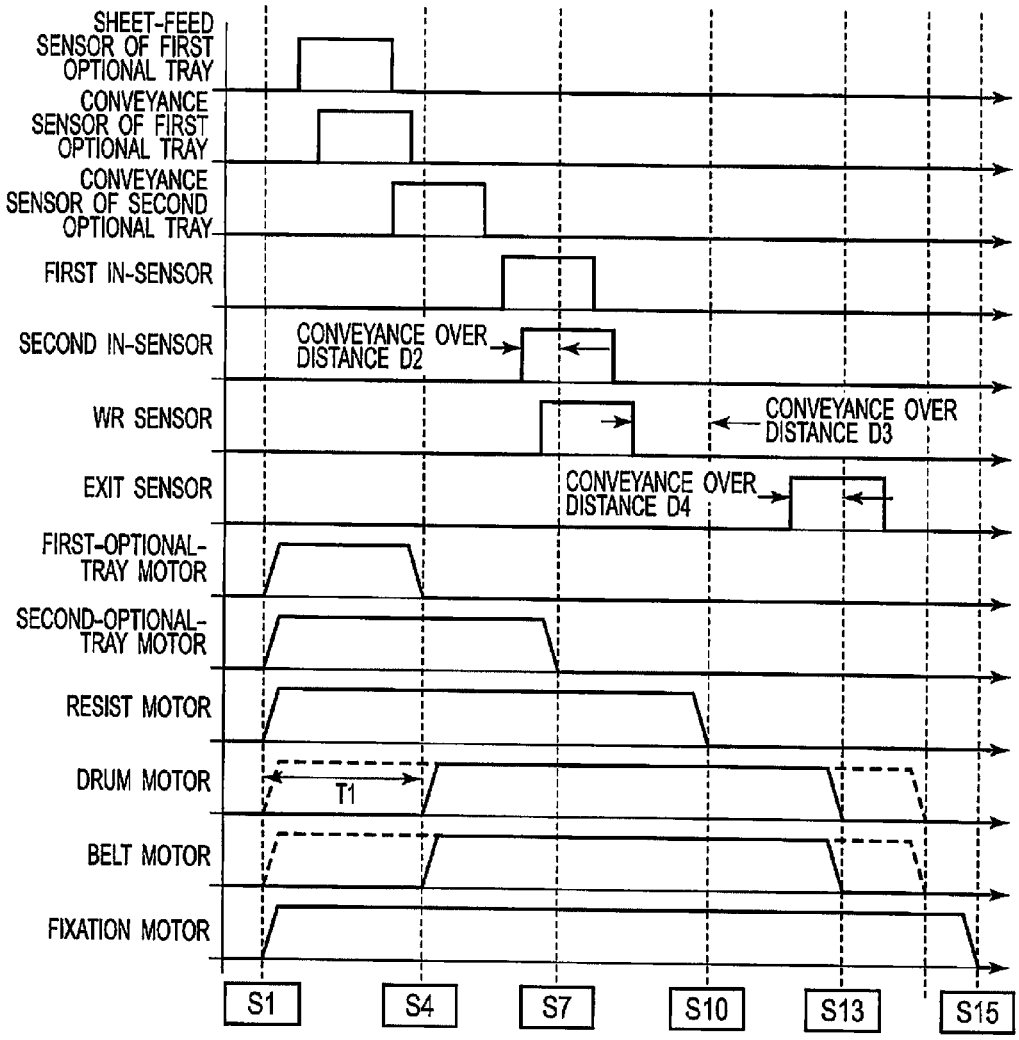
FIG. 14 is a time chart illustrating the operations of the image formation apparatus according to the fourth embodiment of the invention.

FIG. 14 is a time chart illustrating the operations of image formation apparatus 10 of the fourth embodiment of the invention of a case where the charging-process suspension period does not exceed threshold time Tx. Elements in FIG. 14 same as the ones those in FIG. 6 showing the first embodiment are denoted by their respective reference numerals. In the time chart of FIG. 14, the vertical axis represents an ON state at the upper position and an OFF state at the lower position. The horizontal axis represents the passage of time. The thick solid lines are of the control performed in the fourth embodiment while the thick dashed lines represent the control performed in the comparative example.

The process at step S1 is similar to that in the first embodiment. At step S3C, controller 60 waits until time T1 (first time) measured by timer 78 elapses. Time T1 is the length of time starting from the time when the conveyance of print medium 100 begins and ending at a predetermined time by which photosensitive drum 23 and conveyor belt 31 have to start rotating unless toner images cannot be transferred to the surface of print medium 100.

In this fourth embodiment, time T1 refers to the length of time starting from the feeding of print medium 100, for example, from second optional tray 11-2 and ending at the time when the print medium 100 is conveyed to point P shown in FIG. 1. Point P shown in FIG. 1 is a position, the distance from which to the position B where the toner image is transferred by image transfer device 21 is equal to the distance measured from pick-up roller 12-1 of medium feeder F of the main body of image formation apparatus 10 to the position B. The processes at steps S4 to S15 are the same as those in the first embodiment.

Effects of Fourth Embodiment

In image formation apparatus 10 of the fourth embodiment, the timing at which the rotations of photosensitive drum 23 and conveyor belt 31 are started is controlled by the interrupt processing by timer 78 only. Accordingly, the control can be made simpler and more accurate.

Modifications

The invention is not limited to the embodiments described above, but tolerates various other forms of use and modifications. Such various other forms of use and modifications include (a) to (e).

(a) The description of the first to the fourth embodiments is given with a color electrophotographic printer as an example. The invention is not limited to such a case, but is also applicable to other cases where the image formation apparatus is a monochrome photocopier, a color photocopier, a monochrome multifunction printer, a color multifunction printer, or the like with a similar structure.

(b) The description of the first to the fourth embodiments is of the case of direct-transfer image formation apparatus 10 where the toner image is transferred directly from each photosensitive drum 23 to print medium 100 conveyed by conveyor belt 31. The invention, however, is not limited to such a case, but is also applicable to a case where the image formation apparatus is an intermediate-transfer image formation apparatus where the developer image is transferred firstly from each photosensitive drum 23 to an intermediate transfer belt serving as an image carrier and then the developer image on the intermediate transfer belt is transferred to the surface of print medium 100 that is being conveyed. In addition, the invention is also applicable to a case where image formation apparatus 10 is an image formation apparatus that uses no conveyor belt 31.

(c) When there are plural medium feeders in a lower portion of image formation apparatus 10, conveyance of the media and image formation may be performed as follows. First, source of print medium 100 is determined from the following: medium feeder F of the main body of image formation apparatus 10; second optional tray 11-2 additionally provided to the main body of image formation apparatus 10 at the upstream side, in the medium-conveyance direction, of medium feeder F; and first optional tray 11-3 additionally provided to the main body of image formation apparatus 10 at the upstream side, in the medium-conveyance direction, of second optional tray 11-2. Then the rotations of photosensitive drum 23 and conveyor belt 31 may be suspended in the preliminary operations for a length of time that is predetermined depending upon from which feeder print medium 100 is fed.

For example, if print medium 100 is fed from medium feeder F of the main body of image formation apparatus 10, the driving of neither photosensitive drum 23 nor conveyor belt 31 is suspended while print medium 100 is being conveyed from medium feeder F to image transfer device 21. Alternatively, in the above-described case, the driving of photosensitive drum 23 and conveyor belt 31 is suspended temporarily at the same time as the feeding of print medium 100 is started, and then the driving of photosensitive drum 23 and conveyor belt 31 is resumed after a first time elapses since the start of the suspension.

If second optional tray 11-2 is additionally provided and print medium 100 is fed from this second optional tray 11-2, the driving of photosensitive drum 23 and conveyor belt 31 is suspended temporarily along with the start of the feeding of print medium 100 while print medium 100 is being conveyed from second optional tray 11-2 to image transfer position B. Then, the driving of photosensitive drum 23 and conveyor belt 31 is resumed after a second time that is longer than the first time elapses.

If first optional tray 11-3 is additionally provided and print medium 100 is fed from this first optional tray 11-3, the driving of photosensitive drum 23 and conveyor belt 31 is suspended temporarily along with the start of the feeding of print medium 100 while print medium 100 is being conveyed from first optional tray 11-3 to image transfer position B. Then, the driving of photosensitive drum 23 and conveyor belt 31 is resumed after a third time that is longer than the second time elapses.

(d) In the first to the fourth embodiments, both in the case where print medium 100 is fed from second optional tray 11-2 as the second medium feeder and in the case where print medium 100 is fed from first optional tray 11-3 as the first medium feeder, the driving of photosensitive drum 23 and conveyor belt 31 is suspended temporarily while print medium 100 is being conveyed. Even if, however, print medium 100 is fed from medium feeder F of the main body of image formation apparatus 10 as the third medium feeder, the driving of photosensitive drum 23 and conveyor belt 31 may be suspended temporarily on condition that the distance from medium feeder F to image transfer position B is sufficiently long or that the time from the start of conveyance of print medium 100 to the arrival of print medium 100 to image transfer position B is sufficiently long.

(e) In the first to the fourth embodiments, the conveyance-direction dimension of print medium 100 is identified on the basis of the print data sent from a host computer or an external apparatus, but this is not the only method of identifying the dimension. The conveyance-direction dimension of print medium 100 may be detected by detecting the conveyance speed of print medium 100 and the length of time between the turning ON and turning OFF of any one of sheet-feed sensor 14, conveyance sensor 15, first IN-sensor 15-1, second IN-sensor 17, and WR sensor 19. Alternatively, the conveyance-direction dimension of print medium 100 may be detected by special sheet-size sensors provided in medium feeder F and optional trays 11 (11-2 and 11-3).

The invention includes other embodiments in addition to the above-described embodiments without departing from the spirit of the invention. The embodiments are to be considered in all respects as illustrative, and not restrictive. The scope of the invention is indicated by the appended claims rather than by the foregoing description. Hence, all configurations including the meaning and range within equivalent arrangements of the claims are intended to be embraced in the invention.

The invention claimed is:

1. An image formation apparatus comprising:

an image carrier on which a developer image is formed;

an image transfer device configured to transfer the developer image formed on the image carrier to a medium;

a controller configured to control drive of the image carrier and the image transfer device;

a first medium feeder configured to feed the medium in the medium-conveyance direction to convey the medium to the image transfer device;

a medium-size detector configured to detect a conveyance-direction dimension of the medium; and a leading-end detector provided at a first distance from the image transfer device in a downstream direction and configured to detect the leading end of the medium discharged from the image transfer device, wherein the controller is configured to stop driving the image carrier, when the medium is conveyed over a distance obtained by subtracting the first distance from the conveyance-direction dimension after the leading-end detector detects the leading end of the medium.

2. An image formation apparatus comprising:

an image carrier on which a developer image is to be formed;

an image transfer device configured to transfer the developer image formed on the image carrier to a medium at an image transfer position;

a controller configured to control drive of the image carrier and the image transfer device;

a first medium feeder configured to feed the medium to the image transfer position along a medium conveyance path extending from the first medium feeder to the image transfer position; and a medium detector provided between the first medium feeder and the image transfer position in the medium conveyance path, wherein the controller is configured to control the drive of the image carrier on the basis of a medium-detection result by the medium detector, and wherein the controller does not start driving the image carrier if the medium is within a zone that allows transfer of the developer image to the medium to be performed at the image transfer position in time.

3. The image formation apparatus according to claim 2, wherein the zone that allows transfer of the developer image to the medium at image transfer position in time is a position whose distance to the image transfer position along the medium conveyance path is longer than a distance over which the image carrier moves after an image formation process to form the developer image on the image carrier is started until the transfer of the developer image formed on the image carrier to the medium is started.

4. The image formation apparatus according to claim 2, wherein the controller does not start driving the image carrier when the medium will arrive at the image transfer position in time for transfer of the developer image to the medium at the image transfer position.

5. The image formation apparatus according to claim 2, wherein, during the time when the medium will arrive at the image transfer position in time for the transfer of developer image to the medium at the image transfer position, the controller drives the image carrier at a lower speed than after the time.

6. The image formation apparatus according to claim 4, wherein the time when the medium will arrive at the image transfer position in time for the transfer of developer image to the medium at the image transfer position is time from which a time duration until the medium is conveyed to the image transfer position is longer than a time duration from the start of an image formation process to form the developer image on the image carrier until the start of the transfer of the developer image formed on the image carrier to the medium.

7. The image formation apparatus according to claim 2, wherein an image formation process to form the developer image is started when a charging operation commences to electrically charge the image carrier.

8. The image formation apparatus according to claim 2, further comprising:

a charge-voltage judgment device configured to judge whether or not the image carrier charged voltage reaches a level with which an image formation process to form the developer image on the image carrier is ready to start, wherein when the charge-voltage judgment device judges that the image formation process is ready to start, the image formation process begins with formation of an electrostatic latent image without a charging operation to electrically charge the image carrier.

9. The image formation apparatus according to claim 8, wherein on the basis of a length of time elapsed after voltage application to the image carrier is stopped, the charge-voltage judgment portion judges whether or not the charge voltage of the image carrier reaches the charge voltage with which the image formation process is ready to start.

10. The image formation apparatus according to claim 2, further comprising a second medium feeder whose distance to the image transfer device is shorter than a distance from the first medium feeder to the image transfer device, wherein if the medium is fed from the second medium feeder, the controller starts driving the image carrier when feeding of the medium is started, and if the medium is fed from the first medium feeder, the controller does not drive the image carrier when the feeding of the medium is started and starts driving the image carrier when a second time elapses after the feeding of the medium is started.

11. The image formation apparatus according to claim 2, further comprising a second medium feeder whose distance to the image transfer device is shorter than a distance from the first medium feeder to the image transfer device, wherein if the medium is fed from the second medium feeder, the controller does not drive the image carrier when feeding of the medium is started and starts driving the image carrier when a first time elapses after the feeding of the medium is started, and if the medium is fed from the first medium feeder, the controller does not drive the image carrier when the feeding of the medium is started and starts driving the image carrier when a second time longer than the first time elapses after the feeding of the medium is started.

12. The image formation apparatus according to claim 10, further comprising: a third medium feeder whose distance to the image transfer device is shorter than the distance from the second medium feeder to the image transfer device, wherein if the medium is fed from the third medium feeder, the controller starts driving the image carrier when the feeding of the medium is started, and if the medium is fed from the first medium feeder, the controller does not drive the image carrier when the feeding of the medium is started and starts driving the image carrier when a third time longer than the second time elapses after the feeding of the medium is started.

13. The image formation apparatus according to claim 12, wherein the third medium feeder is a medium feeder provided in an image formation apparatus main body, and the first medium feeder and the second medium feeder are additional medium feeders externally provided to the image formation apparatus main body.

14. The image formation apparatus according to claim 11, further comprising:

a third medium feeder whose distance to the image transfer device is shorter than the distance from second medium feeder to the image transfer device, wherein if the medium is fed from the third medium feeder, the controller starts driving the image carrier when the feeding of the medium is started if the medium is fed from the first medium feeder, the controller does not drive the image carrier when the feeding of the medium is started and starts driving the image carrier when a third time longer than the second time elapses after the feeding of the medium is started.

15. The image formation apparatus according to claim 14, wherein the third medium feeder is a medium feeder provided in an image formation apparatus main body, and the first medium feeder and the second medium feeder are additional medium feeders externally provided to the image formation apparatus main body.

16. The image formation apparatus according to claim 2, wherein the image carrier is at least one of a photosensitive drum and an intermediate transfer belt.

17. The image formation apparatus according to claim 2, wherein, when the medium is within a zone that allows transfer of the developer image to the medium at the image transfer position in time, the controller drives the image carrier at a lower speed than when the medium is conveyed downstream of the most downstream position of the zone in the medium conveyance path.

18. An image formation apparatus comprising:

an image carrier on which a developer image is to be formed;

an image transfer device configured to transfer the developer image formed on the image carrier to a medium at an image transfer position;

a controller configured to control drive of the image carrier and the image transfer device;

a first medium feeder configured to feed the medium to the image transfer position along a medium conveyance path extending from the first medium feeder to the image transfer position; and a medium detector provided between the first medium feeder and the image transfer position in the medium conveyance path, wherein the controller is configured to control the drive of the image carrier on the basis of a medium-detection result by the medium detector, and wherein, when the medium is within a zone that allows transfer of the developer image to the medium at the image transfer position in time, the controller drives the image carrier at a lower speed than when the medium is conveyed downstream of the most downstream position of the zone in the medium conveyance path.

19. The image formation apparatus according to claim 18, wherein the zone that allows transfer of the developer image to the medium at image transfer position in time is a position whose distance to the image transfer position along the medium conveyance path is longer than a distance over which the image carrier moves after an image formation process to form the developer image on the image carrier is started until the transfer of the developer image formed on the image carrier to the medium is started.

20. The image formation apparatus according to claim 18, wherein the controller does not start driving the image carrier when the medium will arrive at the image transfer position in time for transfer of the developer image to the medium at the image transfer position.

21. The image formation apparatus according to claim 18, wherein, during the time when the medium will arrive at the image transfer position in time for the transfer of developer image to the medium at the image transfer position, the controller drives the image carrier at a lower speed than after the time.

22. The image formation apparatus according to claim 20, wherein the time when the medium will arrive at the image transfer position in time for the transfer of developer image to the medium at the image transfer position is time from which a time duration until the medium is conveyed to the image transfer position is longer than a time duration from the start of an image formation process to form the developer image on the image carrier until the start of the transfer of the developer image formed on the image carrier to the medium.

23. The image formation apparatus according to claim 18, wherein an image formation process to form the developer image is started when a charging operation commences to electrically charge the image carrier.

24. The image formation apparatus according to claim 18, further comprising:

a charge-voltage judgment device configured to judge whether or not the image carrier charged voltage reaches a level with which an image formation process to form the developer image on the image carrier is ready to start, wherein when the charge-voltage judgment device judges that the image formation process is ready to start, the image formation process begins with formation of an electrostatic latent image without a charging operation to electrically charge the image carrier.

25. The image formation apparatus according to claim 24, wherein on the basis of a length of time elapsed after voltage application to the image carrier is stopped, the charge-voltage judgment portion judges whether or not the charge voltage of the image carrier reaches the charge voltage with which the image formation process is ready to start.

26. The image formation apparatus according to claim 18, further comprising a second medium feeder whose distance to the image transfer device is shorter than a distance from the first medium feeder to the image transfer device, wherein if the medium is fed from the second medium feeder, the controller starts driving the image carrier when feeding of the medium is started, and if the medium is fed from the first medium feeder, the controller does not drive the image carrier when the feeding of the medium is started and starts driving the image carrier when a second time elapses after the feeding of the medium is started.

27. The image formation apparatus according to claim 18, further comprising a second medium feeder whose distance to the image transfer device is shorter than a distance from the first medium feeder to the image transfer device, wherein if the medium is fed from the second medium feeder, the controller does not drive the image carrier when feeding of the medium is started and starts driving the image carrier when a first time elapses after the feeding of the medium is started, and if the medium is fed from the first medium feeder, the controller does not drive the image carrier when the feeding of the medium is started and starts driving the image carrier when a second time longer than the first time elapses after the feeding of the medium is started.

28. The image formation apparatus according to claim 26, further comprising: a third medium feeder whose distance to the image transfer device is shorter than the distance from the second medium feeder to the image transfer device, wherein if the medium is fed from the third medium feeder, the controller starts driving the image carrier when the feeding of the medium is started, and if the medium is fed from the first medium feeder, the controller does not drive the image carrier when the feeding of the medium is started and starts driving the image carrier when a third time longer than the second time elapses after the feeding of the medium is started.

29. The image formation apparatus according to claim 28, wherein the third medium feeder is a medium feeder provided in an image formation apparatus main body, and the first medium feeder and the second medium feeder are additional medium feeders externally provided to the image formation apparatus main body.

30. The image formation apparatus according to claim 27, further comprising:

a third medium feeder whose distance to the image transfer device is shorter than the distance from second medium feeder to the image transfer device, wherein if the medium is fed from the third medium feeder, the controller starts driving the image carrier when the feeding of the medium is started if the medium is fed from the first medium feeder, the controller does not drive the image carrier when the feeding of the medium is started and starts driving the image carrier when a third time longer than the second time elapses after the feeding of the medium is started.

31. The image formation apparatus according to claim 30, wherein the third medium feeder is a medium feeder provided in an image formation apparatus main body, and the first medium feeder and the second medium feeder are additional medium feeders externally provided to the image formation apparatus main body.

32. The image formation apparatus according to claim 18, wherein the image carrier is at least one of a photosensitive drum and an intermediate transfer belt.

33. An image formation apparatus comprising:

an image carrier on which a developer image is to be formed;

an image transfer device configured to transfer the developer image formed on the image carrier to a medium;

a controller configured to control drive of the image carrier and the image transfer device;

a first medium feeder including a first medium feeding device configured to feed a medium therefrom toward the image transfer device in a medium conveyance direction;

a second medium feeder including a second medium feeding device configured to feed a medium therefrom toward the image transfer device in the medium conveyance direction, wherein the controller is configured, when feeding the medium from the first medium feeder, to start to rotate the image carrier when starting to feed the medium from the first medium feeder, and wherein the controller is configured, when feeding the medium from the second medium feeder, to start to rotate the image carrier after starting to feed the medium from the second medium feeder.

34. The image formation apparatus according to claim 33, further comprising:

a medium detector provided upstream of the image transfer device in the medium conveyance direction, wherein the controller is configured to control the rotation of the image carrier on the basis of a medium-detection result by the medium detector.

35. The image formation apparatus according to claim 34, wherein the medium detector is provided in the second medium feeder.

36. The image formation apparatus according to claim 35, wherein the first medium feeder is provided in a body of the image formation apparatus, and wherein the second medium feeder is capable of being attached to the body of the image formation apparatus.

37. The image formation apparatus according to claim 35, wherein the controller is configured to stop the rotation of the image carrier until the medium reaches a predetermined position, based on the medium-detection result of the medium detector.

38. The image formation apparatus according to claim 35, wherein, until the medium reaches a predetermined position in the medium conveyance direction, the controller is configured to rotate the image carrier at a lower speed than when the medium is being conveyed downstream of the predetermined position in the medium conveyance direction.

39. The image formation apparatus according to claim 37, wherein the predetermined position is a position whose distance to the image transfer device along the medium conveyance direction is longer than a distance over which the image carrier moves after an image formation process to form the developer image on the image carrier is started until the transfer of the developer image formed on the image carrier to the medium is started.

40. The image formation apparatus according to claim 33, wherein an electrophotographic process to form the developer image on the image carrier is started when a charging operation starts to electrically charge the image carrier.

41. The image formation apparatus according to claim 33, further comprising:

a charge-voltage judgment device configured to judge whether or not the image carrier charged voltage reaches a level with which an image formation process to form the developer image on the image carrier is ready to start, wherein when the charge-voltage judgment device judges that the image formation process is ready to start, the image formation process begins with formation of an electrostatic latent image.

42. The image formation apparatus according to claim 41, wherein on the basis of a length of time elapsed after voltage application to the image carrier is stopped, the charge-voltage judgment device judges whether or not the charge voltage of the image carrier reaches the level with which the image formation process is ready to start.

43. The image formation apparatus according to claim 33, further comprising:

a medium-size detector configured to detect a conveyance-direction dimension of the medium; and a leading-end detector provided at a first distance from the image transfer device in a downstream direction and configured to detect the leading end of the medium discharged from the image transfer device, wherein the controller is configured to stop the rotation of the image carrier, when the medium is conveyed over a distance obtained by subtracting the first distance from the conveyance-direction dimension detected by the medium-size detector after the leading-end detector detects the leading end of the medium.

44. The image formation apparatus according to claim 33, wherein the image carrier is at least one of a photosensitive drum and an intermediate transfer belt.

45. The image formation apparatus according to claim 33, wherein the controller is configured, when feeding the medium from the first medium feeder, to start to rotate the image carrier before or at a same time as starting to feed the medium from the first medium feeder.

* * * * *